US012624858B2

(12) United States Patent
Lloyd, III et al.

(10) Patent No.: US 12,624,858 B2
(45) Date of Patent: May 12, 2026

(54) ADJUSTABLE VENT

(71) Applicant: Aperture Control Systems LLC, Sacramento, CA (US)

(72) Inventors: Charles Lloyd, III, Encino, CA (US); Charles Lloyd, IV, Encino, CA (US); Jimmy Gao, Riverside, CA (US)

(73) Assignee: Aperture Control Systems LLC, Sacramento, CA (US)

( * ) Notice: Subject to any disclaimer, the term of this patent is extended or adjusted under 35 U.S.C. 154(b) by 0 days.

(21) Appl. No.: 19/378,999

(22) Filed: Nov. 4, 2025

(65) Prior Publication Data

US 2026/0063326 A1 Mar. 5, 2026

Related U.S. Application Data

(63) Continuation-in-part of application No. 19/315,304, filed on Aug. 29, 2025.

(60) Provisional application No. 63/798,800, filed on May 2, 2025, provisional application No. 63/690,010, filed on Sep. 3, 2024.

(51) Int. Cl.
*F24F 13/08* (2006.01)

(52) U.S. Cl.
CPC ..... *F24F 13/084* (2013.01)

(58) Field of Classification Search
CPC ..... F24F 13/084; F24F 13/12; F16B 12/20
USPC ..... 454/254, 220, 274
See application file for complete search history.

(56) References Cited

U.S. PATENT DOCUMENTS

| | | | | |
|---|---|---|---|---|
| 1,039,095 | A * | 9/1912 | Carlson | D06C 3/00 38/102.6 |
| 1,496,378 | A * | 6/1924 | Reichardt | E06B 7/084 454/221 |
| 1,840,667 | A * | 1/1932 | Gustafson | E06B 7/03 454/220 |
| 2,178,253 | A * | 10/1939 | Fader | E06B 7/08 454/224 |
| 4,267,874 | A * | 5/1981 | Pope | E06B 7/03 160/92 |
| 5,046,408 | A * | 9/1991 | Eugenio | F24F 13/1426 137/527.6 |
| 6,786,817 | B2 | 9/2004 | Orendorff | |
| 10,773,197 | B1 * | 9/2020 | Bishop | F24F 13/085 |
| 2003/0220068 | A1 | 11/2003 | Orendorff | |
| 2003/0220070 | A1 | 11/2003 | Orendorff | |
| 2004/0023005 | A1 | 2/2004 | Perez | |

(Continued)

*Primary Examiner* — Avinash A Savani
*Assistant Examiner* — Ryan L Faulkner
(74) *Attorney, Agent, or Firm* — Nolan Heimann LLP; Adam Diament

(57) ABSTRACT

An adjustable vent cover assembly comprises sliding leaves with rigid frames and mesh panels that overlap and slide relative to one another, enabling expansion and contraction in both width and height dimensions. The assembly provides continuous adjustment to any position within its adjustment range through a cross-sliding configuration. A guiding system with clips secured to one leaf and rails on adjacent leaves constrains sliding motion to linear vectors while maintaining proper alignment. Each clip engages its corresponding rail in a channel-like relationship. The rigid frames are formed from metallic material, and mounting features include front flanges, fastener apertures, adhesive surfaces, or bracket attachment points for versatile installation options.

5 Claims, 18 Drawing Sheets

(56) References Cited

U.S. PATENT DOCUMENTS

| | | | | |
|---|---|---|---|---|
| 2021/0140674 | A1* | 5/2021 | McCrea | F24F 13/084 |
| 2023/0073277 | A1* | 3/2023 | Thompson | E04B 1/947 |
| 2025/0189167 | A1 | 6/2025 | Mota | |

* cited by examiner

ADJUSTABLE VENT

CROSS-REFERENCE TO RELATED APPLICATIONS

This application is a continuation-in-part of U.S. application Ser. No. 19/315,304, entitled "Adjustable Vent Cover Assembly," filed Aug. 29, 2025, which claims priority to and benefit of U.S. Provisional Patent Application No. 63/690,010, entitled "Adjustable Vent," filed on Sep. 3, 2024 to Lloyd et al., and claims priority to and benefit of U.S. Provisional Patent Application No. 63/798,800, entitled "Adjustable Vent," filed on May 2, 2025 to Lloyd et al., which are hereby incorporated by reference in their entireties.

FIELD OF INVENTION

The present disclosure relates to ventilation systems and building airflow management, and more particularly to an adjustable vent cover assembly comprising sliding leaves with a clip-and-rail guiding system that allows expansion and contraction in both width and height dimensions to fit various vent opening sizes.

BACKGROUND

In the field of building construction, particularly in the design and installation of ventilation systems for residential and commercial properties, the use of vents for exterior openings in crawl-spaces and attics is a common practice. These vents serve a variety of purposes, including the regulation of air flow, the prevention of moisture buildup, and the deterrence of pests. They also play a critical role in fire safety, particularly in Woodland Urban Interface zones where the risk of wildfires is high and building codes increasingly require ember-resistant vent designs.

Traditionally, these vents are designed and manufactured in specific sizes to fit standard-sized openings. This approach, while effective in many cases, presents several challenges. For one, it requires manufacturers to produce a wide range of vent sizes to accommodate the variety of potential opening dimensions. This can lead to increased manufacturing costs and complexity in inventory management. For builders and contractors, it means having to stock and manage a variety of vent sizes, which can be cumbersome and inefficient.

Furthermore, in the case of older buildings with non-standard vent sizes, finding a vent that fits perfectly can be a challenge. This often necessitates custom-made vents, which can be time-consuming and costly to produce. In addition, in areas prone to wildfires, there is a growing demand for fire-resistant vents that can help prevent the spread of fire through the vent openings. These specialized vents often require multi-stage filtration systems to block embers while maintaining airflow, adding further complexity and cost to their manufacture.

Therefore, there is a clear demand for improvements in the design and manufacture of vents for exterior openings in crawl-spaces and attics. Such improvements could potentially address the aforementioned challenges, offering a more versatile, cost-effective, and fire-safe solution for the construction industry.

Vent openings are commonly installed in residential and commercial buildings to provide airflow for crawl-spaces and attics. These openings typically require a vent cover or grille to prevent debris, pests, and other undesirable matter from entering while also allowing air to flow freely. Conventional vent covers are manufactured in fixed, standard sizes and must precisely match the dimensions of the vent opening for proper installation.

Most vent covers suffer from several limitations in their design and functionality. Fixed-dimension covers require homeowners and installers to purchase covers that exactly match their vent opening dimensions, which can be problematic when openings are non-standard sizes. When dimensional mismatches occur, modification of either the cover or the opening may be necessary, resulting in additional costs and installation time. Some adjustable vent covers exist in the prior art, but they often allow only linear expansion in one direction and tend to be mechanically weak, leaving gaps or misalignments when extended.

Existing adjustable designs often lack precise guiding features, resulting in wobble, rattling, or poor fit when the cover is expanded. These structural weaknesses can compromise both the aesthetic appearance and functional performance of the ventilation system. Additionally, many conventional covers provide limited mounting options, restricting their versatility across different architectural environments and installation requirements. For vents that must comply with wildfire safety codes, the complexity of incorporating multi-stage filtration for ember resistance into an adjustable design has proven particularly challenging, often resulting in expensive custom solutions rather than adaptable, standardized products.

Previous vent assemblies include the following:

U.S. Patent Publication No. 2003/0220068 is directed to a vent assembly having a vent cover and sliding air flow regulator for controlling the flow of air through the vent cover. The assembly includes couplers that interconnect the air flow regulator and vent cover for relative sliding motion, with actuator mechanisms used to move the air flow regulator between open and closed positions.

U.S. Patent Publication No. 2025/0189167 is directed to an adjustable vent cover apparatus comprising devices with elongated rails that interlock with each other. The apparatus includes a first device with openings and tracks, and second and third devices with rails that can be inserted into the openings and lie within the tracks to provide adjustability.

U.S. Pat. No. 6,786,817 is directed to a vent assembly having a vent cover and sliding air flow regulator with plural sets of couplers used to interconnect the air flow regulator and vent cover for relative sliding motion. The assembly provides two couplers at each end with associated couplers being adjacent to corners of rectangular assemblies.

U.S. Patent Publication No. 2003/0220070 is directed to a vent assembly having an air flow regulator slidable relative to a vent cover, wherein the air flow regulator is detachably coupled to the vent cover using plural sets of couplers. The couplers permit sliding of the air flow regulator relative to the vent cover for controlling air flow.

U.S. Patent Publication No. 2004/0023005 is directed to a vent cover for closing building vents, particularly for covering air conditioning vents to prevent heat loss and air leakage. The cover comprises a sheet with sink keyhole slides adjacent to side edges for securing the cover in place with fasteners, and includes adjustable embodiments with multiple members that snap together.

SUMMARY

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

The present invention relates to an adjustable vent cover assembly that can be resized to fit different vent openings while maintaining structural integrity and proper airflow. Unlike conventional fixed-size vent covers, this assembly allows users to adjust both the width and height dimensions to accommodate various opening sizes without requiring custom manufacturing or modification of existing openings. The adjustment may be continuous, allowing positioning at any point within the adjustment range, or may be incremental with discrete positioning steps. The adjustment process may be tool-free for ease of installation, or may incorporate locking mechanisms or fasteners to secure the assembly in a desired configuration.

According to an aspect of the present disclosure, an adjustable vent cover assembly is provided. The assembly comprises a plurality of leaves, each leaf including a rigid frame and a mesh panel secured within the frame. The leaves are configured to overlap and slide relative to one another to allow the assembly to expand and contract in both width and height dimensions, and wherein the assembly is configured for continuous adjustment to any position within an adjustment range.

According to other aspects of the present disclosure, the adjustable vent cover assembly may include one or more of the following features. The plurality of leaves May comprise at least two leaves arranged in a cross-sliding configuration. The assembly may further comprise a guiding system that constrains sliding motion of the leaves to linear vectors and maintains alignment between adjacent leaves. The guiding system may comprise clips secured to a first leaf and rails on an adjacent second leaf, wherein each clip engages a corresponding rail in a channel-like relationship. The rigid frame of each leaf may be formed from a metallic material. The assembly may further comprise mounting features selected from the group consisting of a front flange extending outward from a perimeter of the assembled leaves, apertures for mechanical fasteners, adhesive mounting surfaces, and bracket attachment points. The guiding system may employ at least six clips distributed along interacting leaves, wherein the clips are secured to the first leaf, wherein the mesh panel comprises ember-resistant mesh having apertures of ⅛ inch or smaller, wherein the assembly is configured for tool-free adjustment, and wherein the assembly is configured to expand from a contracted state to an expanded state with expansion ranges allowing coverage from approximately 10×5 inches to approximately 17×8 inches.

According to another aspect of the present disclosure, an adjustable vent cover assembly is provided. The assembly comprises a plurality of sliding leaves arranged in overlapping configuration, each leaf comprising a rigid frame with an embedded mesh panel. The assembly further comprises a guiding system configured to constrain sliding motion of the leaves to maintain alignment between adjacent leaves during expansion and contraction of the assembly in two perpendicular dimensions.

According to other aspects of the present disclosure, the adjustable vent cover assembly may include one or more of the following features. The plurality of sliding leaves may comprise at least two leaves arranged in a cross-sliding configuration. The guiding system may comprise clips secured to a first leaf and rails on an adjacent second leaf. Each clip may engage a corresponding rail in a channel-like relationship to constrain movement to a single linear direction. The rigid frame of each leaf may be formed from a metallic material and the mesh panel comprises mesh material secured within the frame. The assembly may further comprise mounting features selected from the group consisting of a front flange extending outward from a perimeter of the assembled leaves, apertures for mechanical fasteners, adhesive mounting surfaces, and bracket attachment points. The guiding system may employ at least six clips distributed along interacting leaves, wherein the clips are secured to the first leaf, wherein the rigid frame of each leaf is formed from a metallic material, wherein the mesh panel comprises mesh material selected from the group consisting of wire mesh, perforated sheet material, expanded metal, and fire-resistant fabric, wherein the mesh panel comprises ember-resistant mesh having apertures of ⅛ inch or smaller, wherein the assembly is configured for tool-free adjustment, and wherein the assembly is configured to expand from a contracted state where the leaves overlap substantially to an expanded state with expansion ranges allowing coverage from approximately 10× 5 inches to approximately 17×8 inches.

According to a further aspect of the present disclosure, a method of installing an adjustable vent cover assembly is provided. The method comprises providing an adjustable vent cover assembly having a plurality of sliding leaves configured to expand and contract in both width and height. The method further comprises adjusting the dimensions of the assembly to fit a vent opening. The method also comprises securing the assembly to cover the vent opening.

According to other aspects of the present disclosure, the method may include one or more of the following features. The adjustable vent cover assembly may comprise at least two leaves arranged in a cross-sliding configuration, each leaf including a rigid frame and a mesh panel secured within the frame. Adjusting the dimensions may comprise sliding the leaves relative to one another using a guiding system that constrains sliding motion to linear vectors. Securing the assembly may comprise mounting features selected from the group consisting of a front flange, mechanical fasteners, adhesive mounting, and bracket attachment points. The guiding system may comprise clips secured to a first leaf and rails on an adjacent second leaf, and wherein each clip engages a corresponding rail in a channel-like relationship. The adjustable vent cover assembly may comprise at least two leaves with rigid frames formed from metallic material and mesh panels comprising mesh material selected from the group consisting of wire mesh, perforated sheet material, expanded metal, and fire-resistant fabric, wherein the mesh panel comprises ember-resistant mesh having apertures of ⅛ inch or smaller, wherein the guiding system employs at least six clips distributed along interacting leaves with the clips being secured to the first leaf, wherein the guiding system alternatively comprises one of tongue-and-groove joints or dovetail joints between adjacent leaves, wherein adjusting the dimensions comprises expanding the assembly from a contracted state where the leaves overlap substantially to an expanded state with expansion ranges allowing coverage from approximately 10×5 inches to approximately 17×8 inches, wherein the assembly is configured for tool-free adjustment, and wherein securing the assembly comprises using a front flange extending outward from a perimeter of the assembled leaves and mechanical fasteners extending through apertures in the frames.

The foregoing general description of the illustrative embodiments and the following detailed description thereof are merely exemplary aspects of the teachings of this disclosure and are not restrictive.

BRIEF DESCRIPTION OF FIGURES

Non-limiting and non-exhaustive examples are described with reference to the following figures.

DETAILED DESCRIPTION

Figure 1:
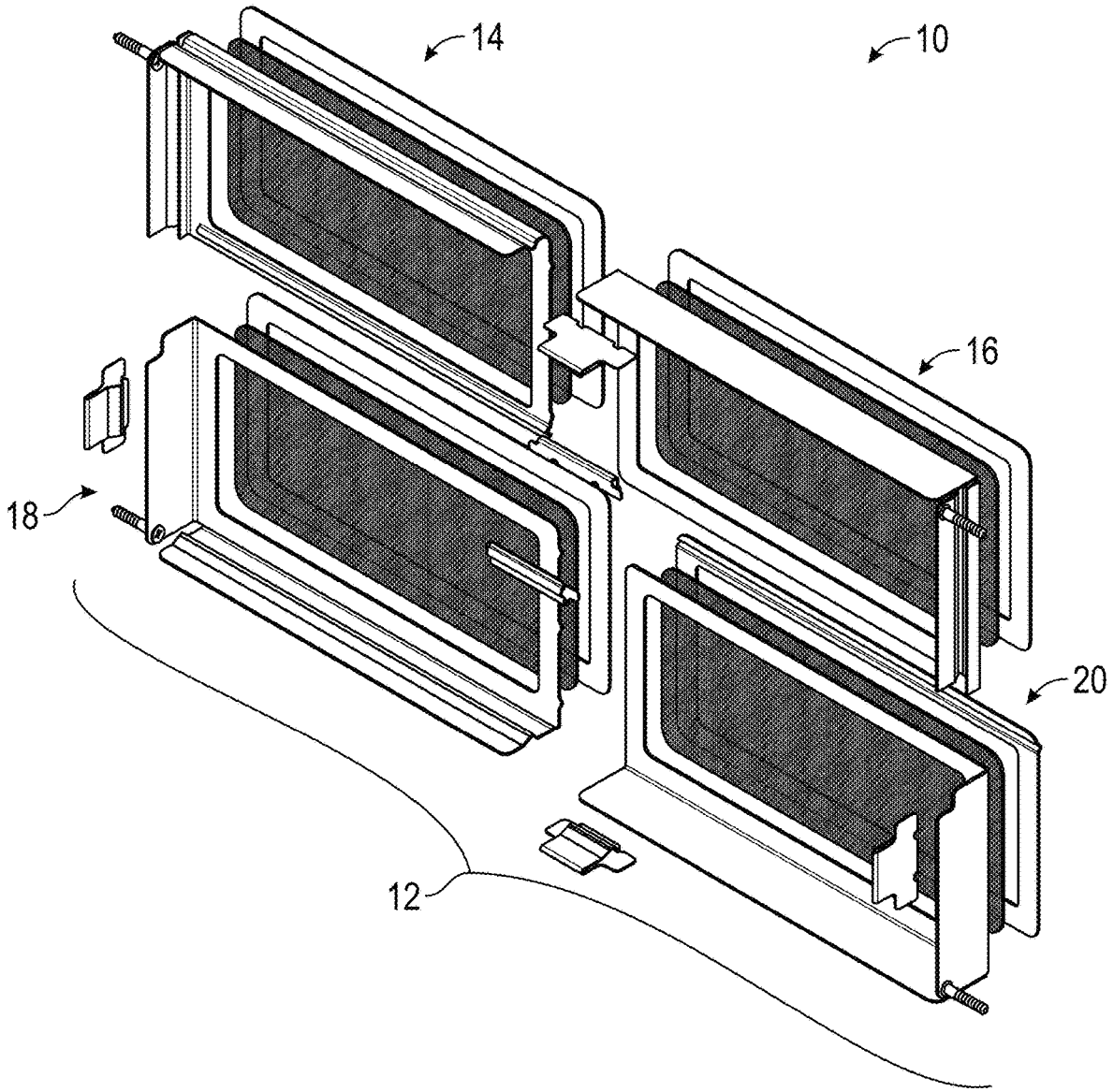
FIG. 1 illustrates an exploded view of an adjustable vent cover assembly, in accordance with one embodiment of the present invention.
Figure 3A:
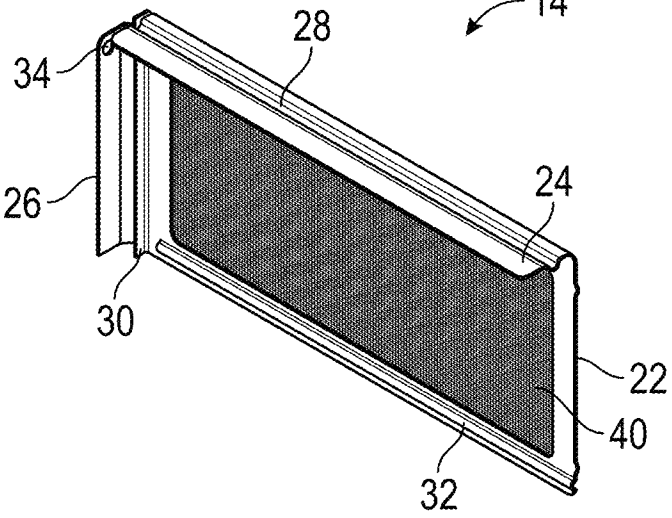
FIG. 3A, FIG. 3B, FIG. 3C, and FIG. 3D illustrate a perspective view, a front view, a top view, and a side view, respectively of the first leaf, in accordance with one embodiment of the present invention.

The following description sets forth exemplary aspects of the present disclosure. It should be recognized, however, that such description is not intended as a limitation on the scope of the present disclosure. Rather, the description also encompasses combinations and modifications to those exemplary aspects described herein.

The invention now will be described more fully hereinafter with reference to the accompanying drawings, in which embodiments of the invention are shown. This invention may however be embodied in many different forms and should not be construed as limited to the embodiments set forth herein. Rather, these embodiments are provided so that this disclosure will be thorough and complete, and will fully convey the scope of the invention to those skilled in the art.

It will be understood that when an element is referred to as being "on" another element, it can be directly on the other element or intervening elements may be present therebetween. As used herein, the term "and/or" includes any and all combinations of one or more of the associated listed items.

It will be understood that, although the terms first, second, third etc. may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section.

It will be understood that the elements, components, regions, layers and sections depicted in the figures are not necessarily drawn to scale.

The terminology used herein is for the purpose of describing particular embodiments only, and is not intended to be limiting of the invention. As used herein, the singular forms "a," "an," and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom," "upper" or "top," "left" or "right," "above" or "below," "front" or "rear," may be used herein to describe one element's relationship to another element as illustrated in the Figures. It will be understood that relative terms are intended to encompass different orientations of the device in addition to the orientation depicted in the figures.

Unless otherwise defined, all terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to idealized embodiments of the present invention. As such, variations from the shapes of the illustrations as a result, for example, of manufacturing techniques and/or tolerances, are to be expected. The numbers, ratios, percentages, and other values may include those that are ±5%, ±10%, ±25%, ±50%, ±75%, ±100%, ±200%, ±500%, or other ranges that do not detract from the spirit of the invention. The terms about, approximately, or substantially may include values known to those having ordinary skill in the art. If not known in the art, these terms may be considered to be in the range of up to ±5%, ±10%, or other value higher than these ranges commonly accepted by those having ordinary skill in the art for the variable disclosed. Thus, embodiments of the present invention should not be construed as limited to the particular shapes of regions illustrated herein but are to include deviations in shapes that result, for example, from manufacturing. The invention illustratively disclosed herein suitably may be practiced in the absence of any elements that are not specifically disclosed herein. All patents, patent applications and non-patent literature cited through this application are hereby incorporated by reference in their entireties.

The adjustable vent cover assembly described herein addresses limitations found in conventional vent covers used for exterior openings in crawl-spaces and attics. Traditional vent covers are manufactured in fixed, standard dimensions, which may create challenges when vent openings have non-standard measurements or when a single cover design may be used across multiple applications with varying opening sizes. In some cases, installers may encounter situations where available vent covers do not precisely match the dimensions of existing openings, potentially leading to gaps, poor fit, or the expense of modifying either the cover or the opening itself.

The adjustment process may be performed without requiring tools, allowing users to manually slide the leaves relative to one another through direct hand pressure applied to the frame structures. The clip-and-rail guiding system provides sufficient mechanical advantage that adjustment forces remain within comfortable manual operation ranges, typically requiring less than 10 pounds of force to initiate sliding movement. The smooth sliding characteristics of the clip-and-rail engagement eliminate the need for mechanical actuators, threaded adjustment mechanisms, or specialized tools during dimensional adjustment operations. The assembly provides continuous adjustment capability, allowing positioning at any point within the adjustment range rather than discrete incremental positions. The clip-and-rail engagement maintains secure positioning at any adjusted dimension through friction forces and mechanical interference between the clip and rail surfaces. This continuous adjustment capability allows precise matching to non-standard opening dimensions that may fall between conventional discrete sizing increments.

The adjustable vent cover assembly provides dimensional flexibility by incorporating sliding components that allow expansion and contraction in both width and height directions. This adjustability may eliminate the constraints associated with fixed-dimension covers while maintaining the fundamental functions of airflow management and debris filtration. The assembly may be configured to span a range of opening sizes using a single unit, potentially reducing inventory requirements for installers and providing homeowners with a versatile solution for various vent opening configurations.

The structural design of the adjustable vent cover assembly incorporates multiple overlapping leaves that slide relative to one another in a controlled manner. Each leaf includes a rigid frame structure and an integrated mesh panel that allows air passage while blocking unwanted materials such as debris, insects, or embers. The sliding mechanism may be guided by specialized components that maintain proper alignment and prevent separation or wobbling during adjustment operations.

In some cases, the assembly may incorporate mounting features that accommodate various installation methods commonly used in the field. These mounting options may include flanged configurations for surface mounting, apertures for mechanical fasteners, or provisions for adhesive attachment methods. The versatility in mounting approaches may allow the adjustable vent cover assembly to be installed in different architectural environments and construction scenarios without requiring specialized tools or modification of standard installation practices.

The materials and construction methods used in the adjustable vent cover assembly may be selected to provide durability and longevity in typical applications for exterior openings in crawl-spaces and attics. The frame components may be formed from metals or other rigid materials that can withstand environmental conditions and repeated adjustment cycles. The mesh components may be selected based on the specific filtration requirements of the application, with options for different mesh densities or specialized materials depending on the intended use environment.

Referring to FIG. 1, an exploded view of an adjustable vent cover assembly 10 is shown, in accordance with one embodiment of the present invention. The adjustable vent cover assembly 10 provides dimensional flexibility for covering vent openings of various sizes through controlled expansion and contraction capabilities. The adjustable vent cover assembly 10 incorporates sliding leaves 12 that enable the dimensional adjustability functionality. The sliding leaves 12 are arranged in an overlapping configuration that allows relative movement between adjacent leaves. The sliding leaves 12 expand and contract in both width and height dimensions through coordinated sliding motion.

The adjustable vent cover assembly 10 may utilize two, three, five, six, or more sliding leaves 12 depending on size range and application requirements. The number of sliding leaves 12 may be selected based on the desired adjustment range, structural strength requirements, and manufacturing complexity considerations for particular use cases. The configuration of sliding leaves 12 allows the adjustable vent cover assembly 10 to accommodate various vent opening dimensions using a single adjustable unit rather than requiring multiple fixed-size covers for different opening sizes.

The sliding leaves 12 function as modular components that work together to provide complete coverage of vent openings throughout the adjustment range. The overlapping arrangement of the sliding leaves 12 maintains continuous coverage while allowing dimensional changes through controlled sliding movement. The sliding leaves 12 are configured to slide relative to one another along predetermined vectors to achieve the desired dimensional adjustments without creating gaps or uncovered areas that could compromise the functionality of the adjustable vent cover assembly 10.

In one exemplary embodiment, the sliding leaves 12 include four sliding leaves 12 that work together in a cross-sliding configuration to provide dimensional adjustability. The sliding leaves 12 include a first leaf 14, a second leaf 16, a third leaf 18, and a fourth leaf 20. Each of these individual leaf components contributes to the overall functionality of the adjustable vent cover assembly 10 through coordinated sliding movement and structural interaction. The first leaf 14 is positioned to interact with adjacent leaf components through sliding interfaces that enable dimensional adjustment of the adjustable vent cover assembly 10. The arrangement of the first leaf 14, second leaf 16, third leaf 18, and fourth leaf 20 in the cross-sliding configuration allows the adjustable vent cover assembly 10 to expand and contract in perpendicular dimensions. The four leaf components are positioned so that sliding movement between adjacent leaves creates dimensional changes in both width and height directions. The interaction between the first leaf 14, second leaf 16, third leaf 18, and fourth leaf 20 maintains continuous coverage of the vent opening throughout the adjustment range while providing structural stability and proper alignment during dimensional adjustment operations.

Figure 2:
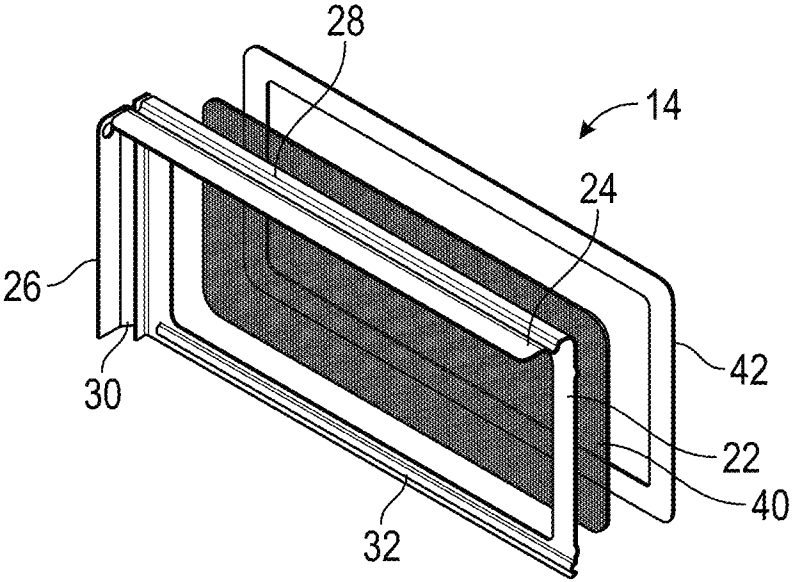
FIG. 2 illustrates an exploded view of a first leaf of the adjustable vent cover assembly, in accordance with one embodiment of the present invention.
Figure 3B:
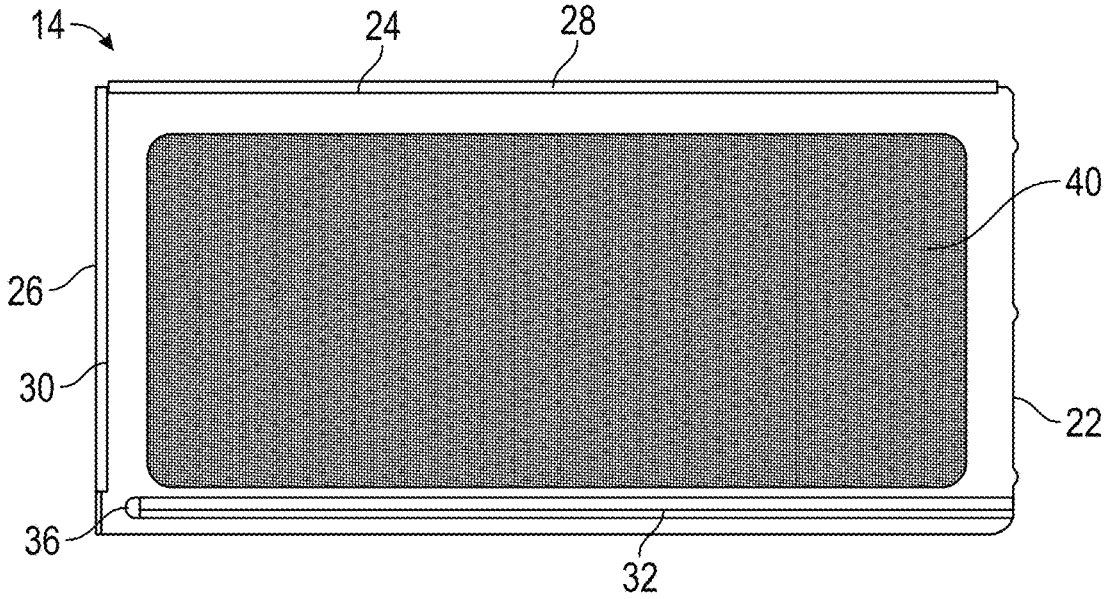
Figure 3C:
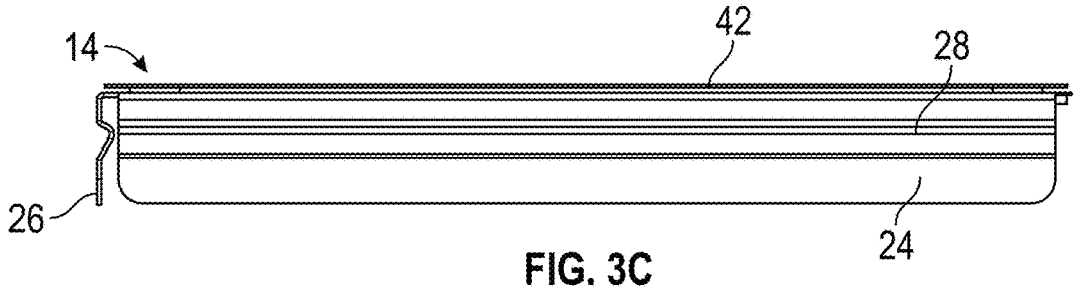
Figure 3D:
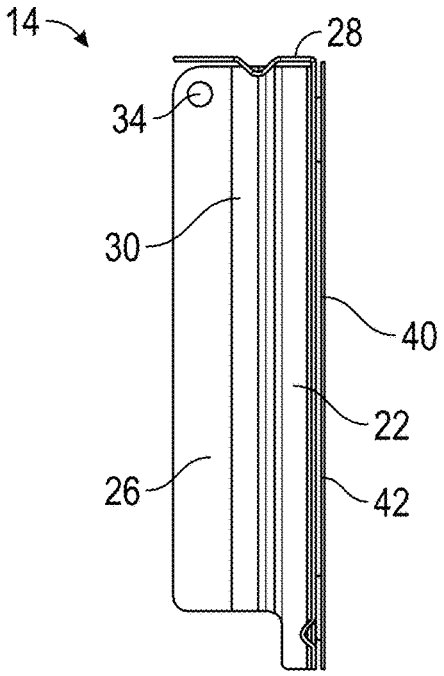

FIG. 2 shows an exploded view of the first leaf 14, in accordance with one embodiment of the present invention. Further, FIG. 3A, FIG. 3B, FIG. 3C, and FIG. 3D show a perspective view, a front view, a top view, and a side view, respectively, of the first leaf 14, in accordance with one embodiment of the present invention. The first leaf 14 includes a first frame 22. The first frame 22 functions as the load-bearing component that supports other elements of the first leaf 14 and provides mounting interfaces for interaction with adjacent leaf components in the adjustable vent cover assembly 10. The first frame 22 comes in a rectangular configuration. The first frame 22 may be formed from various materials selected for structural stability and environmental durability. In one example, the first frame 22 may be formed from steel to provide strength and rigidity for the sliding mechanism operations. The first frame 22 may alternatively be formed from aluminum, polymer composites, or reinforced plastics as alternatives to steel construction. The material selection for the first frame 22 may be based on factors such as weight requirements, corrosion resistance, manufacturing considerations, and cost constraints for particular applications.

The first frame 22 includes a first plate 24 that extends perpendicularly from the top edge of the first frame 22. The first plate 24 provides additional structural support and creates mounting surfaces for components that interact with adjacent leaves in the adjustable vent cover assembly 10. The first plate 24 extends outward from the first frame 22 to create a flanged configuration that enhances the structural rigidity of the first leaf 14 and provides mechanical interfaces for the sliding mechanism. The first plate 24 serves as a mounting platform for rail components and other mechanical elements that enable the sliding functionality of the first leaf 14. The perpendicular orientation of the first plate 24 relative to the first frame 22 creates a structural configuration that distributes mechanical loads and provides stability during sliding operations. The first plate 24 may be formed as an integral part of the first frame 22 through bending or forming operations, or the first plate 24 may be attached to the first frame 22 through welding, fastening, or other joining methods.

Further, the first frame 22 includes a second plate 26 that extends perpendicularly from the side edge of the first frame 22. The second plate 26 provides structural support and mounting surfaces similar to the first plate 24, but oriented in a different direction to accommodate the cross-sliding configuration of the adjustable vent cover assembly 10. The second plate 26 creates additional mechanical interfaces that enable interaction between the first leaf 14 and adjacent leaf components. The second plate 26 enhances the rigidity of the first frame 22 while providing mounting points for guiding components that control the sliding motion of the first leaf 14. The second plate 26 may be formed as an integral part of the first frame 22 through bending or forming operations, or the second plate 26 may be attached to the first frame 22 through welding, fastening, or other joining methods.

In addition, the first frame 22 includes a first rail 28. The first rail 28 provides a guidance surface for the sliding mechanism of the adjustable vent cover assembly 10. The first rail 28 is positioned at the top of the first plate 24 and extends along the length of the first plate 24 to create a continuous guiding interface. The first rail 28 functions as a mechanical constraint that enables controlled sliding movement between the first leaf 14 and adjacent leaf components in the adjustable vent cover assembly 10. The first rail 28 may be formed through metal forming processes such as bending, rolling, or stamping that create raised edges or channels. The forming operations create a rail geometry that provides mechanical engagement surfaces for corresponding clip components on adjacent leaves. The first rail 28 may be formed as an integral part of the first plate 24 through bending operations that create a raised edge or channel configuration along the length of the first plate 24. The dimensional characteristics of the first rail 28 are configured to provide appropriate clearances and engagement surfaces for smooth sliding operation while maintaining structural integrity during repeated adjustment cycles.

The first frame 22 further includes a second rail 30. The second rail 30 extends from the second plate 26 to provide additional guidance functionality for the sliding mechanism. The second rail 30 is positioned along the second plate 26 and oriented perpendicular to the first rail 28 to accommodate the cross-sliding configuration of the adjustable vent cover assembly 10. The second rail 30 creates a mechanical interface that enables sliding interaction between the first leaf 14 and adjacent leaf components along a different vector than the first rail 28. The second rail 30 provides structural guidance that maintains proper alignment between the first leaf 14 and adjacent leaves during dimensional adjustment operations. The second rail 30 may be formed using similar metal forming processes as the first rail 28, including bending, rolling, or stamping operations that create the appropriate rail geometry.

The first frame 22 further includes a third rail 32. The third rail 32 is positioned at the bottom of the first frame 22. The third rail 32 provides additional guidance and structural support for the sliding mechanism of the adjustable vent cover assembly 10. The third rail 32 extends along the bottom edge of the first frame 22 to create a third guidance interface that works in conjunction with the first rail 28 and second rail 30 to maintain proper alignment and controlled movement during adjustment operations. The third rail 32 may be formed through the same metal forming processes used for the first rail 28 and second rail 30, creating a rail geometry that provides appropriate engagement characteristics with corresponding components on adjacent leaves. The positioning of the third rail 32 at the bottom of the first frame 22 creates a distributed guidance system that maintains alignment throughout the adjustment range.

In one embodiment, the first frame 22 includes a first hole 34. The first hole 34 is positioned at mounting aperture for mechanical fasteners. The first hole 34 is provided at the top of the second plate 26 and creates an attachment point for securing the first leaf 14. Further, the first frame 22 includes a second hole 36. The second hole 36 positions at the bottom of the first frame 22 is a relief hole drilled at the end of rail 32 and ensures that the process of pressing the rail into the plate does not tear the adjacent material. The first hole 34 is sized to accommodate mechanical fasteners such as screws, bolts, or other threaded fasteners commonly used in vent cover installation applications. The first hole 34 and the second hole 36 may be formed through drilling, punching, or other machining operations that create an aperture with appropriate dimensional tolerances for the intended fastener types.

Further, the first leaf 14 includes a first mesh panel 40 that provides filtration functionality for the adjustable vent cover assembly 10. The first mesh panel 40 is secured within the first frame 22 and allows controlled airflow passage while blocking unwanted materials such as debris, insects, or embers from entering through the vent opening. The first mesh panel 40 functions as the primary filtration element of the first leaf 14 and contributes to the overall performance of the adjustable vent cover assembly 10. The first mesh panel 40 may comprise wire mesh, perforated sheet material, expanded metal, or fire-resistant fabric to provide various filtration characteristics depending on the application requirements. The material selection for the first mesh panel 40 may be based on factors such as airflow resistance, particle blocking capability, environmental durability, and fire safety requirements. The first mesh panel 40 may comprise ember-resistant mesh having apertures of ⅛ inch or smaller for wildfire protection in applications where fire safety is a concern.

The first mesh panel 40 may be secured within channels or grooves using mechanical fastening methods, adhesive bonding, or combination thereof. The attachment method for the first mesh panel 40 ensures proper retention within the first frame 22 during handling, installation, and service conditions. The first mesh panel 40 is positioned within the first frame 22 to provide complete coverage of the opening while maintaining appropriate tension and alignment for optimal filtration performance.

The first mesh panel 40 is dimensioned to fit within the interior boundaries of the first frame 22 while providing complete coverage of the airflow passage. The first mesh panel 40 maintains structural integrity during airflow conditions and environmental exposure while providing consistent filtration performance throughout the service life of the adjustable vent cover assembly 10. The first mesh panel 40 works in conjunction with mesh panels in other leaf components to provide complete filtration coverage across the entire adjustment range of the adjustable vent cover assembly 10.

The first leaf 14 includes a first back frame 42 that provides structural support for the first mesh panel 40 and enhances the overall rigidity of the first leaf 14. The first back frame 42 is positioned at the rear of the first leaf 14 and creates additional structural reinforcement that maintains dimensional stability during sliding operations and environmental conditions. The first back frame 42 functions as a support structure that supports the first mesh panel 40 and distributes mechanical loads across the first leaf 14 structure.

The first back frame 42 provides structural continuity that prevents deformation or distortion of the first mesh panel 40 during airflow conditions or external forces. The first back frame 42 is configured to work in conjunction with the first frame 22 to create a rigid assembly that maintains proper alignment and dimensional characteristics throughout the adjustment range of the adjustable vent cover assembly 10. The first back frame 42 may be attached to the first frame 22 through welding, fastening, or other joining methods that create a permanent structural connection.

Figure 4:
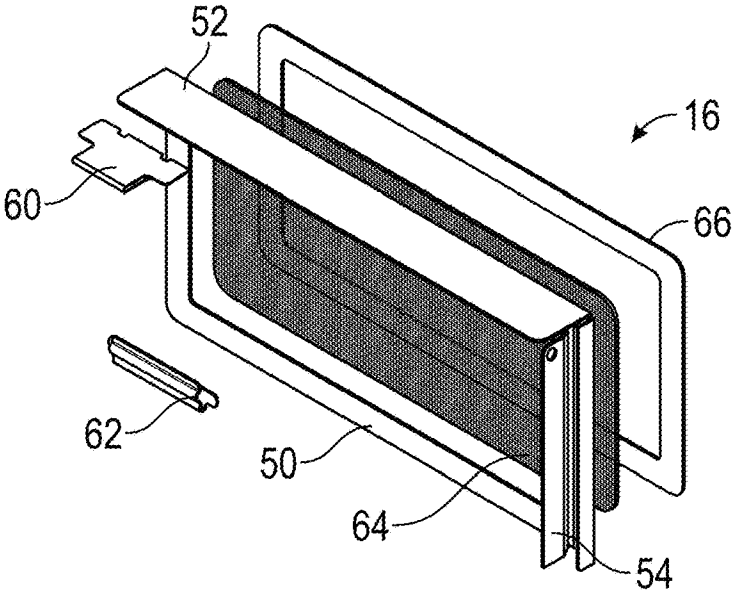
FIG. 4 illustrates an exploded view of a second leaf of the adjustable vent cover assembly, in accordance with one embodiment of the present invention.
Figure 5B:
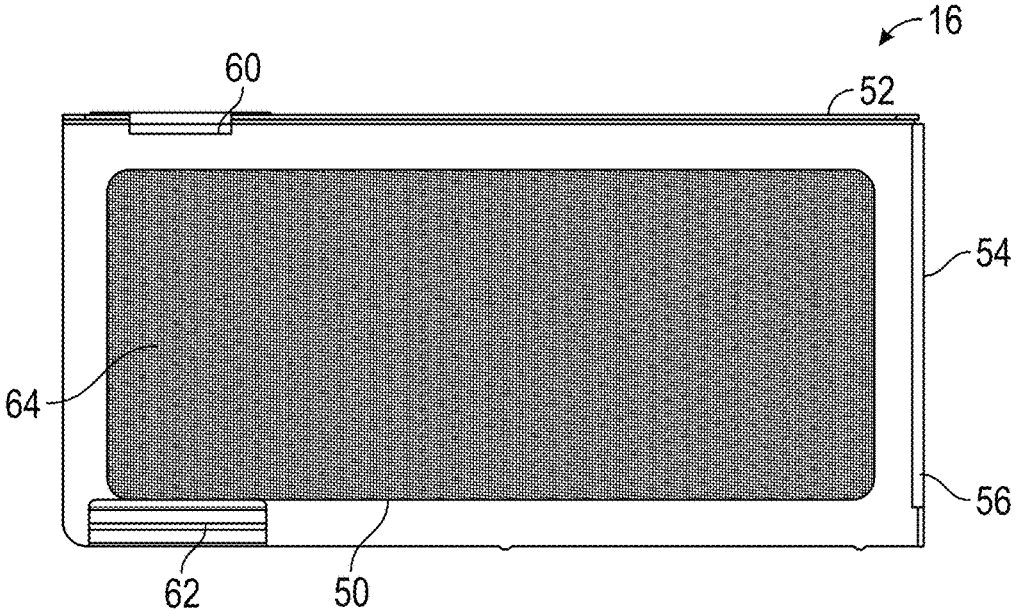
Figure 5C:
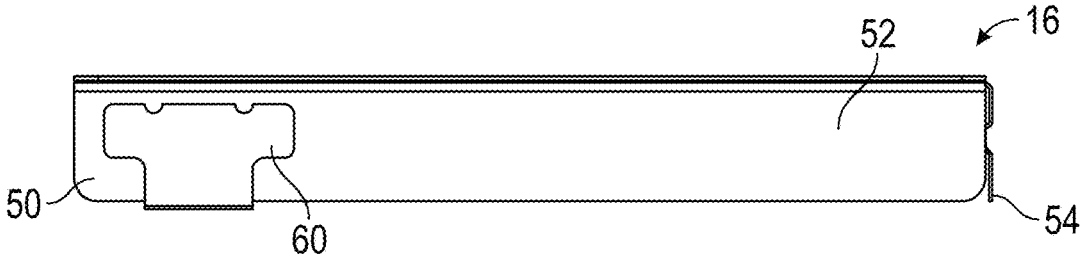
Figure 5D:
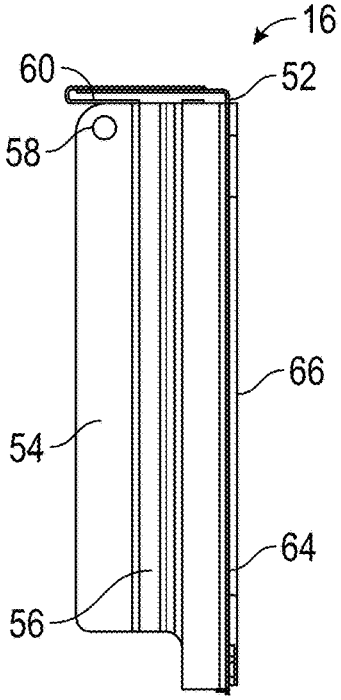

FIG. 4 shows an exploded view of the second leaf 16, in accordance with one embodiment of the present invention. Further, FIG. 5A, FIG. 5B, FIG. 5C, and FIG. 5D show a perspective view, a front view, a top view, and a side view, respectively, of the second leaf 16, in accordance with one embodiment of the present invention. The second leaf 16 includes a second frame 50. The second frame 50 comes in a rectangular configuration that defines the overall dimensions and structural boundaries of the second leaf 16. The second frame 50 may be formed from various materials selected for structural stability and environmental durability. In some cases, the second frame 50 may be formed from steel to provide strength and rigidity for the sliding mechanism operations. The second frame 50 may alternatively be formed from aluminum, polymer composites, or reinforced plastics as alternatives to steel construction. The material selection for the second frame 50 may be based on factors such as weight requirements, corrosion resistance, manufacturing considerations, and cost constraints for particular applications.

Figure 5A:
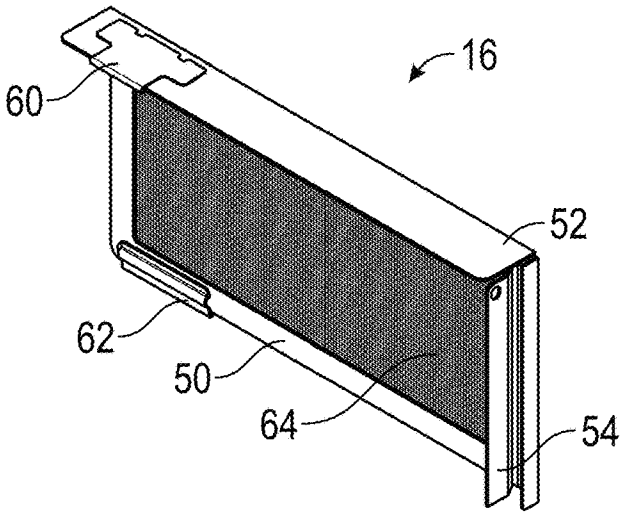
FIG. 5A, FIG. 5B, FIG. 5C, and FIG. 5D illustrate a perspective view, a front view, a top view, and a side view, respectively of the second leaf, in accordance with one embodiment of the present invention.

The second frame 50 includes a third plate 52 that extends perpendicularly from the top edge of the second frame 50, as can be seen from FIG. 5A. The third plate 52 extends outward from the second frame 50 to create a flanged configuration that provides mechanical interfaces for the sliding mechanism. The third plate 52 may be formed as an integral part of the second frame 50 through bending or forming operations, or the third plate 52 may be attached to the second frame 50 through welding, fastening, or other joining methods.

The second frame 50 includes a fourth plate 54 that extends perpendicularly from the side edge of the second frame 50. The fourth plate 54 provides structural support and mounting surfaces similar to the third plate 52, but oriented in a different direction to accommodate the cross-sliding configuration of the adjustable vent cover assembly 10. The fourth plate 54 creates additional mechanical interfaces that enable interaction between the second leaf 16 and adjacent leaf components. The fourth plate 54 provides mounting points for guiding components that control the sliding motion of the second leaf 16. The perpendicular orientation of the fourth plate 54 relative to the second frame 50 creates a flanged structure that distributes mechanical forces and maintains dimensional stability during adjustment operations. The fourth plate 54 may be formed as an integral part of the second frame 50 through bending or forming operations, or the fourth plate 54 may be attached to the second frame 50 through welding, fastening, or other joining methods.

The combination of the third plate 52 and fourth plate 54 with the second frame 50 creates a structural assembly that provides multiple mounting surfaces and mechanical interfaces oriented in different directions. This configuration enables the second leaf 16 to interact with adjacent leaf components through various sliding vectors while maintaining structural integrity throughout the adjustment range of the adjustable vent cover assembly 10. The third plate 52 and fourth plate 54 work together to create a rigid framework that supports the sliding mechanism and maintains proper alignment during dimensional adjustment operations.

The second frame 50 includes a fourth rail 56. The fourth rail 56 is positioned at the inner side of the fourth plate 54 and extends along the length of the fourth plate 54 to create a continuous guiding interface. The fourth rail 56 may be formed through metal forming processes such as bending, rolling, or stamping that create raised edges or channels. The forming operations create a rail geometry that provides mechanical engagement surfaces for corresponding clip components on adjacent leaves. The fourth rail 56 may be formed as an integral part of the fourth plate 54 through bending operations that create a raised edge or channel configuration along the length of the fourth plate 54. The dimensional characteristics of the fourth rail 56 are configured to provide appropriate clearances and engagement surfaces for smooth sliding operation while maintaining structural integrity during repeated adjustment cycles. In the present embodiment, the fourth rail 56 functions as a mechanical constraint that enables controlled sliding movement between the second leaf 16 and adjacent leaf components in the adjustable vent cover assembly 10.

The second frame 50 includes a third hole 58 that functions as a mounting aperture for mechanical fasteners. The third hole 58 is provided at the top of the fourth plate 54 and creates an attachment point for securing the second leaf 16 to building surfaces through conventional fastening methods using screws, bolts, or other threaded fasteners commonly used in vent cover installation applications. The third hole 58 may be formed through drilling, punching, or other machining operations that create a clean aperture with appropriate dimensional tolerances for the intended fastener types. The third hole 58 may be sized to accommodate wood screws, sheet metal screws, or machine screws depending on the mounting substrate and structural requirements of the installation. The third hole 58 may include countersunk or counterbored features to allow fastener heads to sit flush with the surface of the fourth plate 54, maintaining a finished appearance and preventing interference with adjacent components during sliding operations of the adjustable vent cover assembly 10.

Further, the second leaf 16 includes a first border clip 60. The first border clip 60 may be formed from steel sheet material through stamping, cutting, or machining operations. The manufacturing processes create a clip geometry that provides appropriate engagement characteristics with corresponding rail structures on adjacent leaves. The first border clip 60 acts as an engagement element for the sliding mechanism of the adjustable vent cover assembly 10. The first border clip 60 is positioned at the top of the third plate 52 and provides mechanical engagement with corresponding rail components on adjacent leaves. The first border clip 60 may be attached to the third plate 52 through welding to provide permanent attachment and structural continuity between the clip component and the second leaf 16 structure. The first border clip 60 may alternatively be attached through riveting, crimping, or integral formation as alternatives to welding.

The first border clip 60 enables controlled sliding movement between the second leaf 16 and adjacent first leaf 14 while maintaining proper alignment throughout the adjustment range. The first border clip 60 creates a mechanical interface that constrains sliding movement to predetermined vectors while preventing unwanted displacement or separation from adjacent leaf components. The first border clip 60 engages with corresponding rail structures in a channel-like relationship that allows smooth linear movement along the rail direction while restricting movement in other directions. The first border clip 60 provides structural guidance that maintains proper alignment between the second leaf 16 and adjacent leaves during dimensional adjustment operations of the adjustable vent cover assembly 10.

Further, the second leaf 16 includes a first center clip 62. The first center clip 62 is located at the bottom of the second frame 50 and provides mechanical engagement with corresponding components on adjacent leaves in the adjustable vent cover assembly 10. The first center clip 62 may be formed from steel sheet material through stamping, cutting, or machining operations similar to the first border clip 60. The manufacturing processes create a clip geometry that provides mechanical engagement with corresponding rail or frame structures on adjacent leaves. The first center clip 62 may be attached to the second frame 50 through welding to provide permanent structural connection. The first center clip 62 may alternatively be attached through riveting, crimping, or integral formation as alternatives to welding. The first center clip 62 creates a mechanical constraint to maintain proper alignment and prevent unwanted movement of the second leaf 16 relative to adjacent leaf components.

In addition, the second leaf 16 includes a second mesh panel 64. The second mesh panel 64 provides filtration functionality for the adjustable vent cover assembly 10. The second mesh panel 64 is secured within the second frame 50 and allows controlled airflow passage while blocking unwanted materials such as debris, insects, or embers from entering through the vent opening. The second mesh panel 64 functions as the primary filtration element of the second leaf 16 and contributes to the overall performance of the adjustable vent cover assembly 10. The second mesh panel 64 may comprise wire mesh, perforated sheet material, expanded metal, or fire-resistant fabric to provide various filtration characteristics depending on the application requirements. The material selection for the second mesh panel 64 may be based on factors such as airflow resistance, particle blocking capability, environmental durability, and fire safety requirements. The second mesh panel 64 may comprise ember-resistant mesh having apertures of ⅛ inch or smaller for wildfire protection in applications where fire safety is a concern.

The second mesh panel 64 may be secured within channels or grooves using mechanical fastening methods, adhesive bonding, or combination thereof. The attachment method for the second mesh panel 64 ensures proper retention within the second frame 50 during handling, installation, and service conditions. The second mesh panel 64 is dimensioned to fit within the interior boundaries of the second frame 50 while providing complete coverage of the airflow passage. The second mesh panel 64 works in conjunction with the first mesh panel 40 and other mesh panels to provide complete filtration coverage across the entire adjustment range of the adjustable vent cover assembly 10.

The second leaf 16 incorporates a second back frame 66 that provides structural support for the second mesh panel 64 and enhances the overall rigidity of the second leaf 16. The second back frame 66 is positioned at the rear of the second leaf 16 assembly and creates additional structural reinforcement that maintains dimensional stability during sliding operations and environmental conditions. The second back frame 66 functions as a support component that supports the second mesh panel 64 and distributes mechanical loads across the second leaf 16 structure. The second back frame 66 provides structural continuity that prevents deformation or distortion of the second mesh panel 64 during airflow conditions or external forces. The second back frame 66 is configured to work in conjunction with the second frame 50 to create a rigid assembly that maintains proper alignment and dimensional characteristics throughout the adjustment range of the adjustable vent cover assembly 10. The second back frame 66 may be attached to the second frame 50 through welding, fastening, or other joining methods that create a permanent structural connection.

Figure 6:
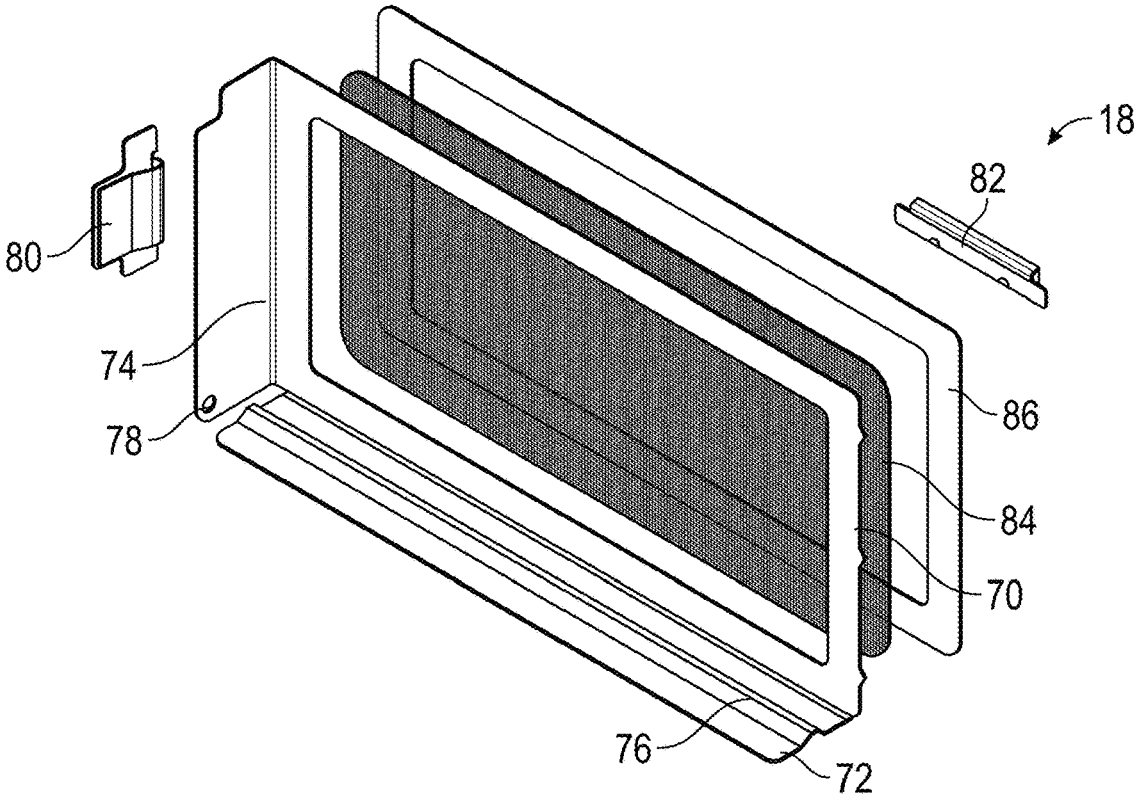
FIG. 6 illustrates an exploded view of a third leaf of the adjustable vent cover assembly, in accordance with one embodiment of the present invention.
Figure 7A:
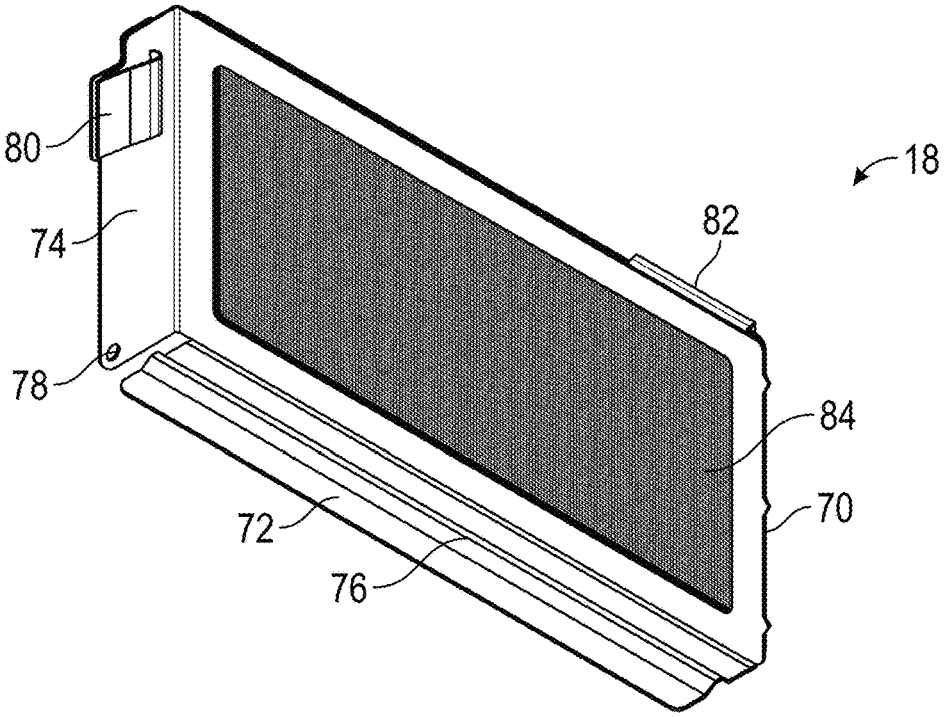
FIG. 7A, FIG. 7B, FIG. 7C, and FIG. 7D illustrate a perspective view, a front view, a top view, and a side view, respectively of the third leaf, in accordance with one embodiment of the present invention.
Figure 7B:
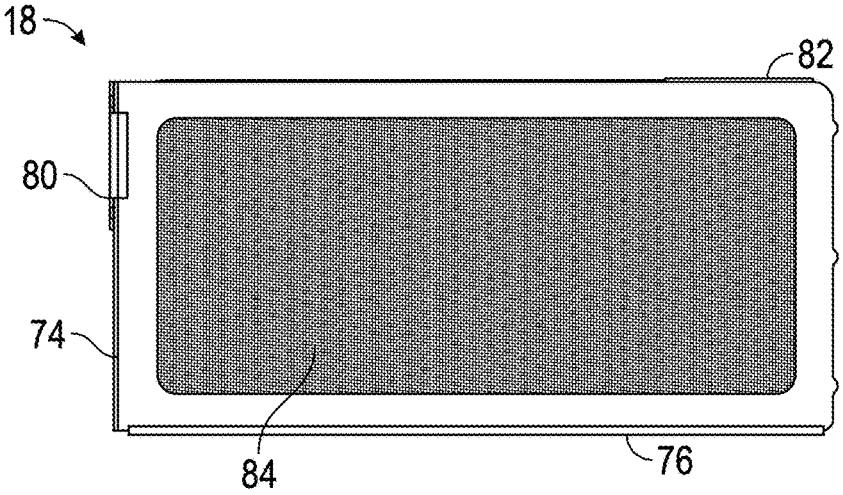
Figure 7C:
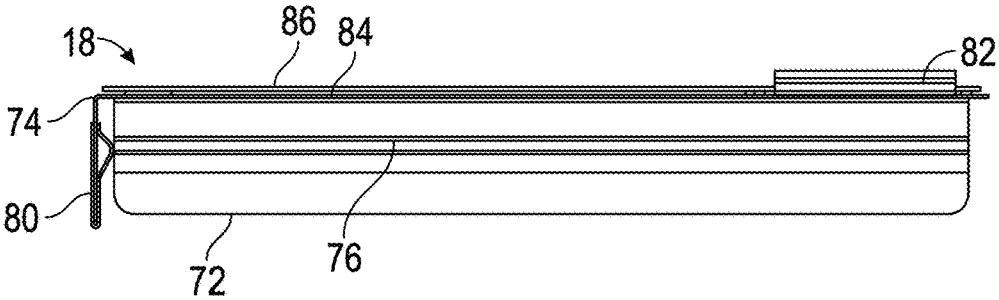
Figure 7D:
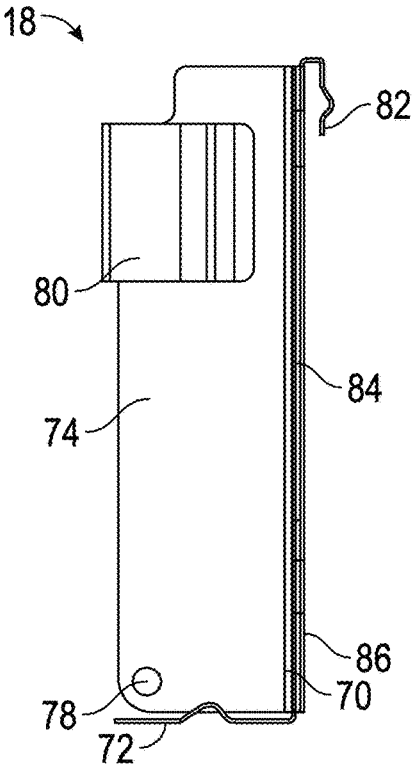

FIG. 6 shows an exploded view of the third leaf 18, in accordance with one embodiment of the present invention. Further, FIG. 7A, FIG. 7B, FIG. 7C, and FIG. 7D show a perspective view, a front view, a top view, and a side view, respectively, of the third leaf 18, in accordance with one embodiment of the present invention. The third leaf 18 includes a third frame 70. The third frame 70 comes in a rectangular configuration that defines the overall dimensions and structural boundaries of the third leaf 18. The third frame 70 may be formed from various materials selected for structural stability and environmental durability. In some cases, the third frame 70 may be formed from steel to provide strength and rigidity for the sliding mechanism operations. The third frame 70 may alternatively be formed from aluminum, polymer composites, or reinforced plastics as alternatives to steel construction. The material selection for the third frame 70 may be based on factors such as weight requirements, corrosion resistance, manufacturing considerations, and cost constraints for particular applications.

The third frame 70 includes a fifth plate 72. The fifth plate 72 extends perpendicularly from the bottom edge of the third frame 70. The fifth plate 72 extends outward from the third frame 70 to create a flanged configuration that provides mechanical interfaces for the sliding mechanism. Here, the fifth plate 72 serves as a mounting platform for rail components and other mechanical elements that enable the sliding functionality of the third leaf 18. The fifth plate 72 may be formed as an integral part of the third frame 70 through bending or forming operations, or the fifth plate 72 may be attached to the third frame 70 through welding, fastening, or other joining methods.

The third frame 70 includes a sixth plate 74. The sixth plate 74 extends perpendicularly from the side edge of the third frame 70. The sixth plate 74 provides a mounting interface that enables interaction between the third leaf 18 and adjacent leaf components i.e., first leaf 14. In some cases, the sixth plate 74 functions as a structural element that enhances the rigidity of the third frame 70 while providing mounting interfaces for guiding components that control the sliding motion of the third leaf 18. The perpendicular orientation of the sixth plate 74 relative to the third frame 70 creates a flanged structure that distributes mechanical forces and maintains dimensional stability during adjustment operations. The sixth plate 74 may be formed as an integral part of the third frame 70 through bending or forming operations, or the sixth plate 74 may be attached to the third frame 70 through welding, fastening, or other joining methods.

The third frame 70 includes a fifth rail 76. The fifth rail 76 is positioned at the inner side of the fifth plate 72 and extends along the length of the fifth plate 72 to create a continuous guiding interface. The fifth rail 76 functions as a mechanical constraint that enables controlled sliding movement between the third leaf 18 and adjacent leaf components i.e., fourth leaf 20 in the adjustable vent cover assembly 10. The fifth rail 76 may be formed through metal forming processes such as bending, rolling, or stamping that create raised edges or channels. The forming operations create a rail geometry that provides mechanical engagement surfaces for corresponding clip components on adjacent leaves. The fifth rail 76 may be formed as an integral part of the fifth plate 72 through bending operations that create a raised edge or channel configuration along the length of the fifth plate 72. The dimensional characteristics of the fifth rail 76 are configured to provide appropriate clearances and engagement surfaces for smooth sliding operation while maintaining structural integrity during repeated adjustment cycles.

Further, the third leaf 18 includes a second border clip 80. The second border clip 80 functions as an engagement element for the sliding mechanism of the adjustable vent cover assembly 10. The second border clip 80 is positioned at the top of the sixth plate 74 and provides mechanical engagement with corresponding rail components on adjacent leaves (e.g., second rail 30 on first leaf 14). The second border clip 80 enables controlled sliding movement between the third leaf 18 and adjacent first leaf 14 while maintaining proper alignment throughout the adjustment range. The second border clip 80 engages with second rail 30 on first leaf 14 in a channel-like relationship and allows smooth linear movement along the rail direction while restricting movement in other directions. The second border clip 80 may be formed from steel sheet material through stamping, cutting, or machining operations. The manufacturing processes create a clip geometry that provides appropriate engagement characteristics with corresponding rail structures on adjacent leaves. The second border clip 80 may be attached to the sixth plate 74 through welding to provide permanent attachment and structural continuity between the clip component and the third leaf 18 structure. The second border clip 80 may alternatively be attached through riveting, crimping, or integral formation as alternatives to welding.

The third leaf 18 includes a second center clip 82. The second center clip 82 is located at the top and back of the third frame 70 and provides mechanical engagement with corresponding components on adjacent leaves in the adjustable vent cover assembly 10. The second center clip 82 may be formed from steel sheet material through stamping, cutting, or machining operations similar to the second border clip 80. The manufacturing processes create a clip geometry that provides mechanical engagement with corresponding rail or frame structures on adjacent leaves. The second center clip 82 may be attached to the third frame 70 through welding to provide permanent structural connection. The second center clip 82 may alternatively be attached through riveting, crimping, or integral formation as alternatives to welding. The second center clip 82 provides additional structural support and guidance that enhances the stability of the sliding mechanism during adjustment operations. The second center clip 82 creates a mechanical constraint that works with the second border clip 80 to maintain proper alignment and prevent unwanted movement of the third leaf 18 relative to adjacent leaf components.

Figure 15A:
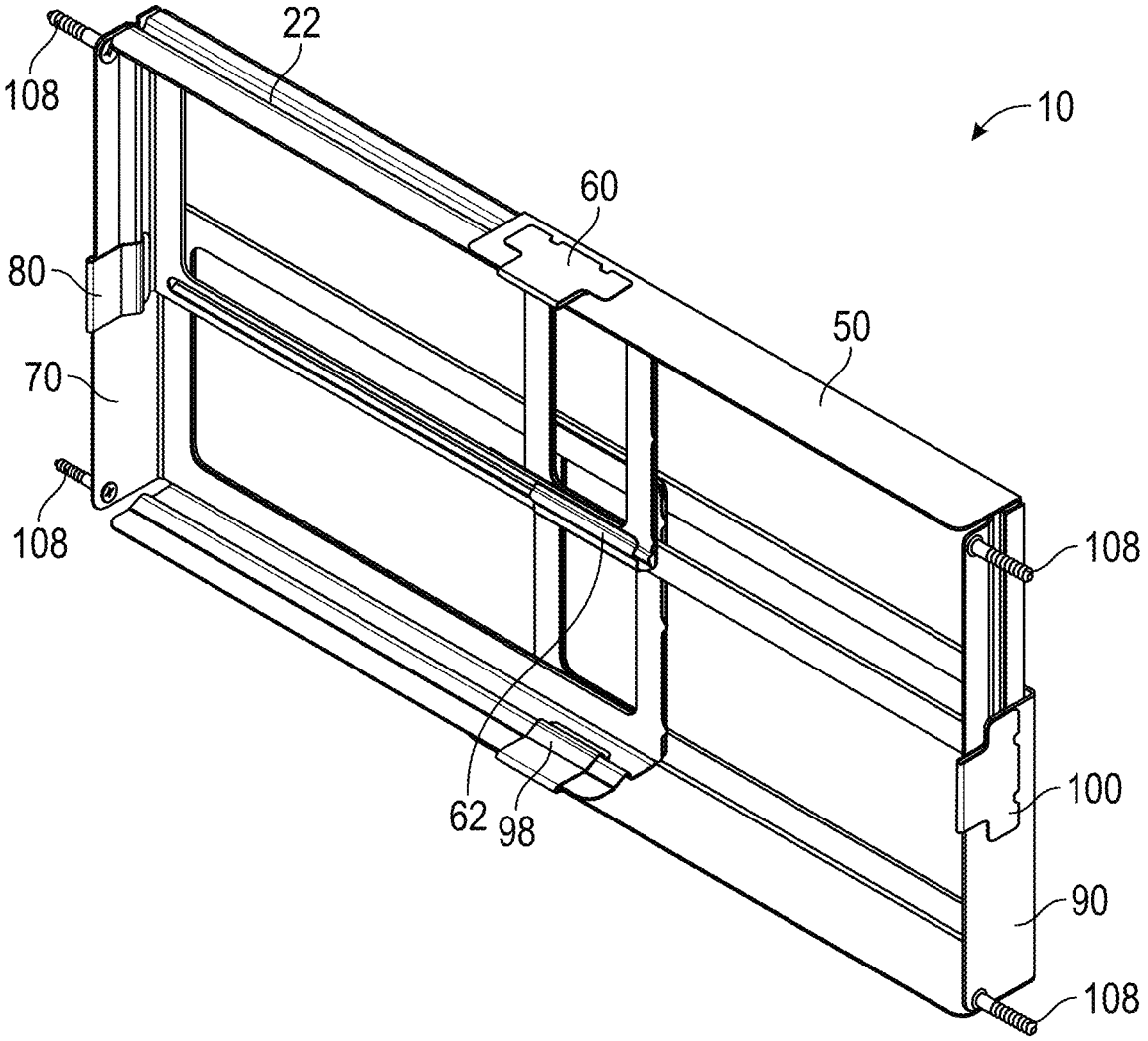
FIG. 15A, FIG. 15B, FIG. 15C, and FIG. 15D illustrate a perspective view, a top view, a front view, and a side view, respectively of the adjustable vent cover assembly in an expanded configuration, in accordance with one embodiment of the present invention.
Figure 15B:
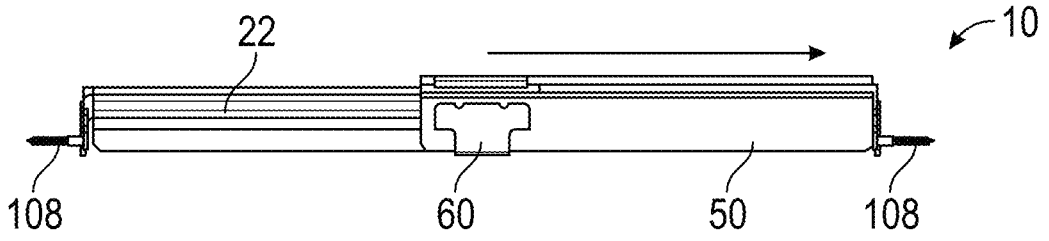
Figure 15C:
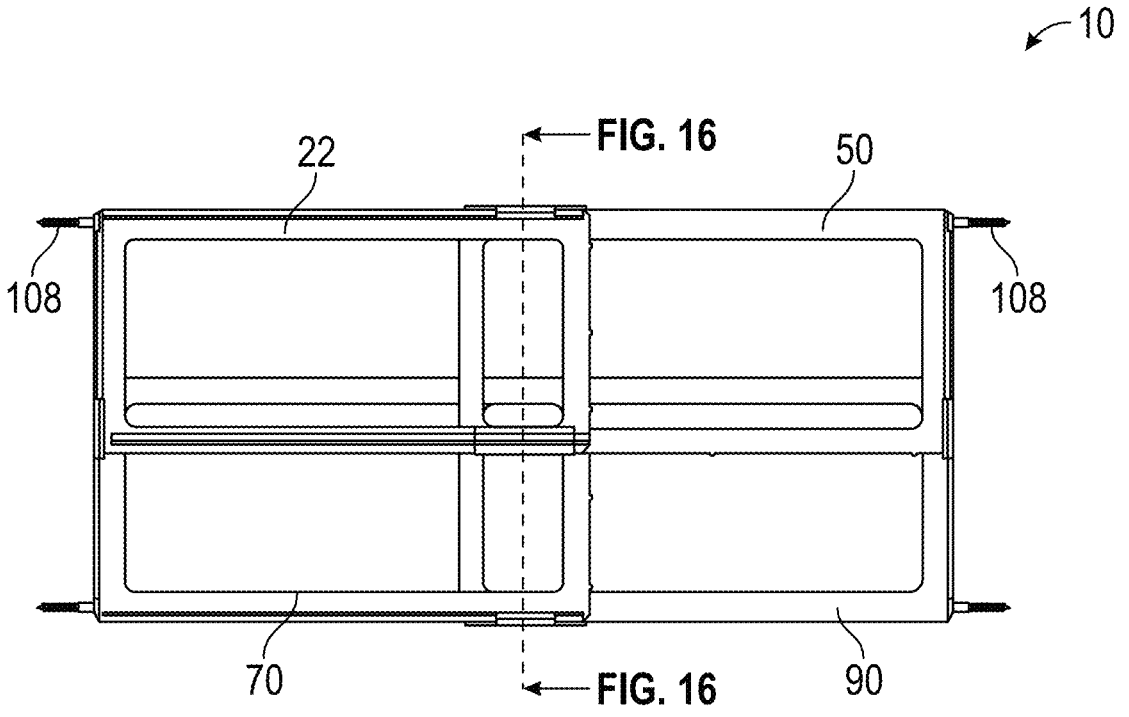

In addition, the third frame 70 includes a fourth hole 78. The fourth hole 78 is provided at the bottom of the sixth plate 74 and creates an attachment point for securing the third leaf 18 to building surfaces through conventional fastening methods using screws, bolts, or other threaded fasteners commonly used in vent cover installation applications. Here, fourth hole 78 functions as a mounting aperture for mechanical fasteners. The positioning of the fourth hole 78 near the bottom of the sixth plate 74, and above the fifth plate 72 that allows fasteners (e.g., fastener 108, as shown in FIG. 15A) to be inserted through the fourth hole 78 and into the mounting substrate without interfering with the sliding mechanism or other functional components of the adjustable vent cover assembly 10. The fourth hole 78 may be formed through drilling, punching, or other machining operations that create a clean aperture with appropriate dimensional tolerances for the intended fastener types. The fourth hole 78 may be sized to accommodate wood screws, sheet metal screws, or machine screws depending on the mounting substrate and structural requirements of the installation. The fourth hole 78 may include countersunk or counterbored features to allow fastener heads to sit flush with the surface of the fifth plate 72, maintaining a finished appearance and preventing interference with adjacent components during sliding operations of the adjustable vent cover assembly 10.

The third leaf 18 includes a third mesh panel 84. The third mesh panel 84 is secured within the third frame 70 and allows controlled airflow passage while blocking unwanted materials such as debris, insects, or embers from entering through the vent opening. The third mesh panel 84 functions as the primary filtration element of the third leaf 18 and contributes to the overall performance of the adjustable vent cover assembly 10. The third mesh panel 84 may comprise wire mesh, perforated sheet material, expanded metal, or fire-resistant fabric to provide various filtration characteristics depending on the application requirements. The material selection for the third mesh panel 84 may be based on factors such as airflow resistance, particle blocking capability, environmental durability, and fire safety requirements. The third mesh panel 84 may comprise ember-resistant mesh having apertures of ⅛ inch or smaller for wildfire protection in applications where fire safety is a concern.

The third mesh panel 84 may be secured within channels or grooves using mechanical fastening methods, adhesive bonding, or combination thereof. The attachment method for the third mesh panel 84 ensures proper retention within the third frame 70 during handling, installation, and service conditions. The third mesh panel 84 is positioned within the third frame 70 to provide complete coverage of the opening while maintaining appropriate tension and alignment for optimal filtration performance. The third mesh panel 84 is dimensioned to fit within the interior boundaries of the third frame 70 while providing complete coverage of the airflow passage. The third mesh panel 84 maintains structural integrity during airflow conditions and environmental exposure while providing consistent filtration performance throughout the service life of the adjustable vent cover assembly 10.

The third mesh panel 84 may be secured through crimping operations that mechanically deform portions of the third frame 70 material to capture and retain the mesh edges. The crimping process creates localized deformation of the third frame 70 material around the perimeter of the third mesh panel 84, creating mechanical retention that prevents mesh displacement during handling and service conditions. The crimping operations may be performed at regular intervals around the mesh perimeter to provide distributed retention forces, with the crimp geometry selected to maintain proper mesh tension while preventing damage to the third mesh panel 84 material during the forming process.

The third leaf 18 includes a third back frame 86. The third back frame 86 provides structural support for the third mesh panel 84 and enhances the overall rigidity of the third leaf 18. The third back frame 86 is positioned at the rear of the third leaf 18 assembly and creates additional structural reinforcement that maintains dimensional stability during sliding operations and environmental conditions. The third back frame 86 functions as a backing component that supports the third mesh panel 84 and distributes mechanical loads across the third leaf 18 structure. The third back frame 86 provides structural continuity that prevents deformation or distortion of the third mesh panel 84 during airflow conditions or external forces. The third back frame 86 is configured to work in conjunction with the third frame 70 to create a rigid assembly that maintains proper alignment and dimensional characteristics throughout the adjustment range of the adjustable vent cover assembly 10. The third back frame 86 may be attached to the third frame 70 through welding, fastening, or other joining methods that create a permanent structural connection.

Figure 8:
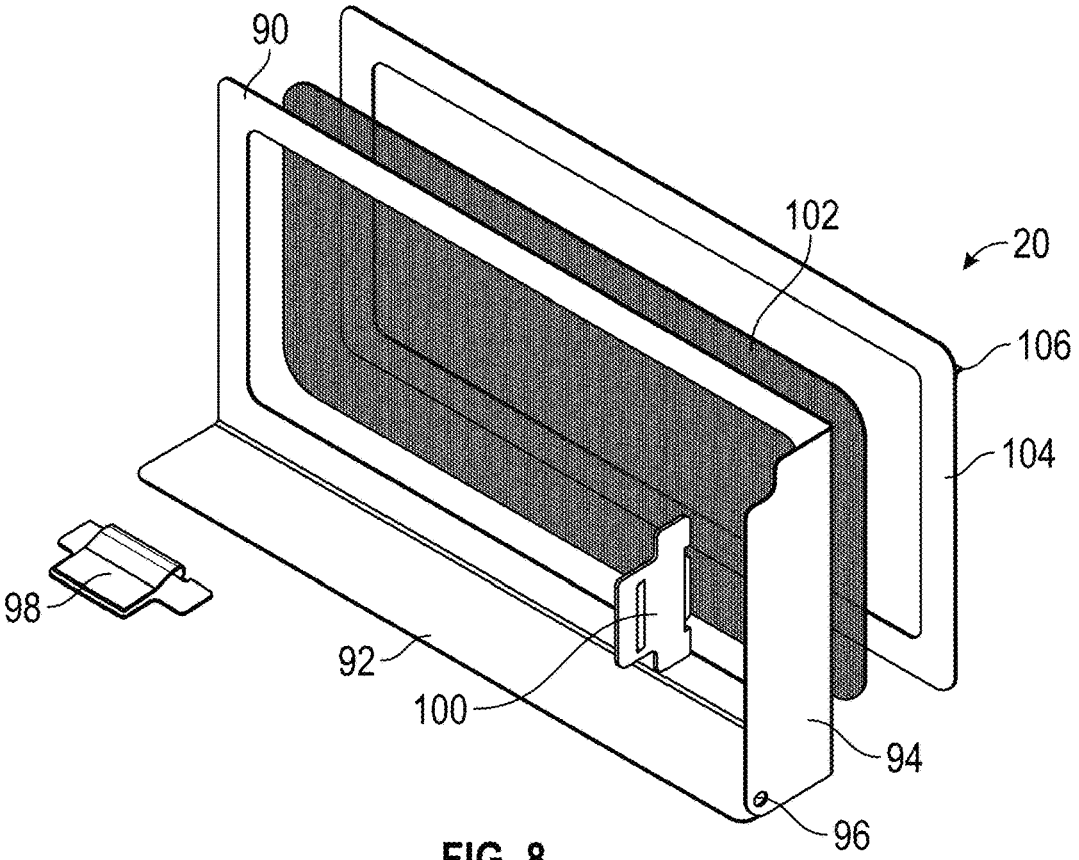
FIG. 8 illustrates an exploded view of a fourth leaf of the adjustable vent cover assembly, in accordance with one embodiment of the present invention.
Figure 9A:
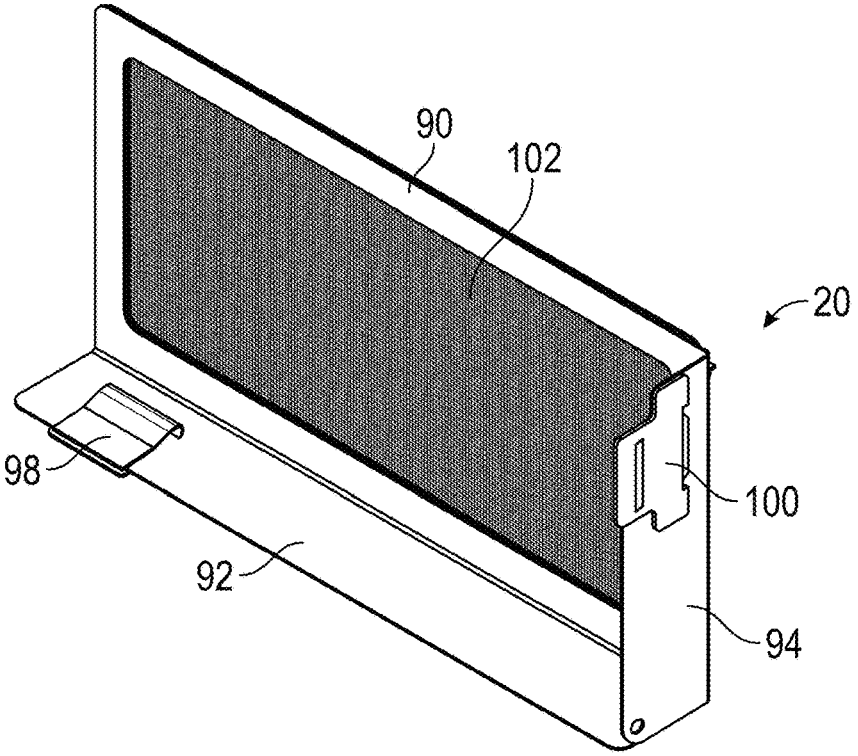
FIG. 9A, FIG. 9B, FIG. 9C, and FIG. 9D illustrate a perspective view, a front view, a top view, and a side view, respectively of the fourth leaf, in accordance with one embodiment of the present invention.
Figure 9B:
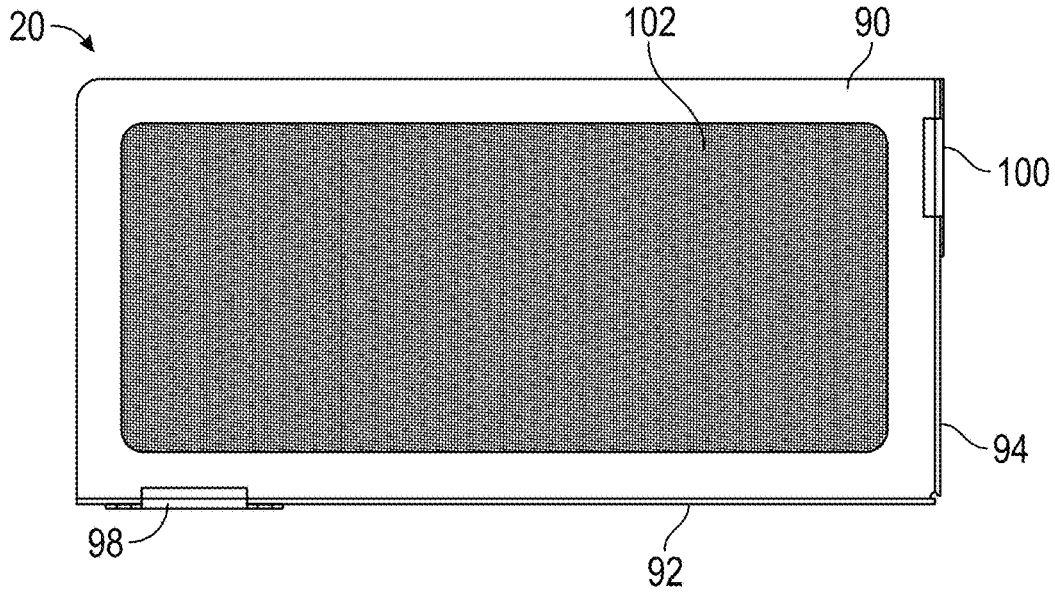
Figure 9C:
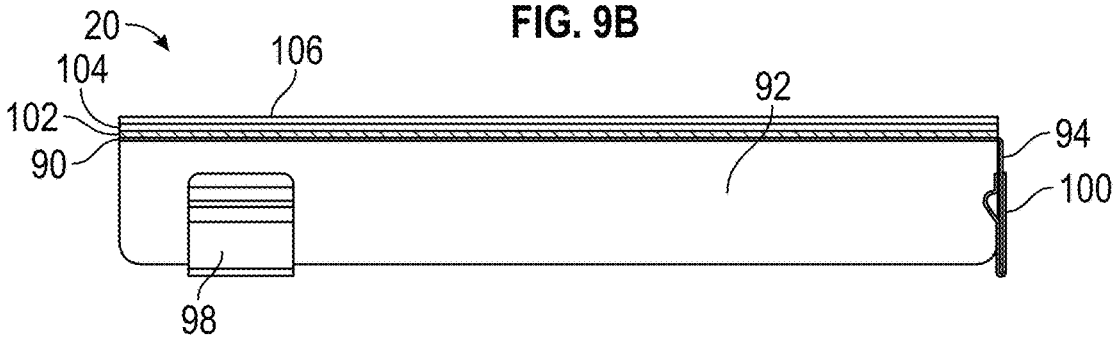
Figure 9D:
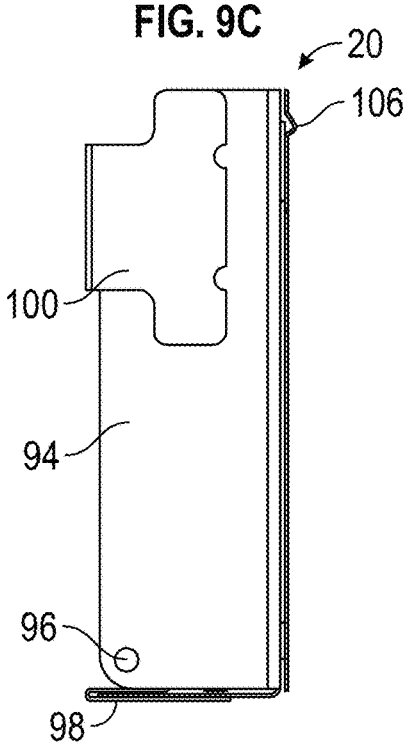

FIG. 8 shows an exploded view of the fourth leaf 20, in accordance with one embodiment of the present invention. Further, FIG. 9A, FIG. 9B, FIG. 9C, and FIG. 9D show a perspective view, a front view, a top view, and a side view, respectively, of the fourth leaf 20, in accordance with one embodiment of the present invention. The fourth leaf 20 includes a fourth frame 90. The fourth frame 90 comes in a rectangular configuration that defines the overall dimensions and structural boundaries of the fourth leaf 20. The fourth frame 90 may be formed from various materials selected for structural stability and environmental durability. In some cases, the fourth frame 90 may be formed from steel to provide strength and rigidity for the sliding mechanism operations. The fourth frame 90 may alternatively be formed from aluminum, polymer composites, or reinforced plastics as alternatives to steel construction. The material selection for the fourth frame 90 may be based on factors such as weight requirements, corrosion resistance, manufacturing considerations, and cost constraints for particular applications.

The fourth frame 90 includes a seventh plate 92 that extends perpendicularly from the bottom edge of the fourth frame 90. The seventh plate 92 extends outward from the fourth frame 90 to create a flanged configuration that enhances the structural rigidity of the fourth leaf and provides mechanical interfaces for the sliding mechanism. The seventh plate 92 serves as a mounting platform for rail components and other mechanical elements that enable the sliding functionality of the fourth leaf 20. The seventh plate 92 may be formed as an integral part of the fourth frame 90 through bending or forming operations, or the seventh plate 92 may be attached to the fourth frame 90 through welding, fastening, or other joining methods.

Further, the fourth frame 90 includes an eighth plate 94 that extends perpendicularly from the side edge of the fourth frame 90. The eighth plate 94 provides structural support and mounting surfaces similar to the seventh plate 92, but oriented in a different direction to accommodate the cross-sliding configuration of the adjustable vent cover assembly 10. The eighth plate 94 creates additional mechanical interfaces that enable interaction between the fourth leaf 20 and adjacent leaf i.e., second leaf 16. The eighth plate 94 may be formed as an integral part of the fourth frame 90 through bending or forming operations, or the eighth plate 94 may be attached to the fourth frame 90 through welding, fastening, or other joining methods.

Furthermore, the fourth frame 90 includes a fourth hole 96 (as shown in at least FIG. 8 and FIG. 9D) that functions as a mounting aperture for mechanical fasteners. The fourth hole 96 is provided at the bottom of the eighth plate 94 and creates an attachment point for securing the fourth leaf 20. The fourth hole 96 enables the fourth leaf 20 to be secured to building surfaces through conventional fastening methods using screws, bolts, or other threaded fasteners commonly used in vent cover installation applications. The fourth hole 96 may be formed through drilling, punching, or other machining operations that create a clean aperture with appropriate dimensional tolerances for the intended fastener types. The fourth hole 96 may be sized to accommodate wood screws, sheet metal screws, or machine screws depending on the mounting substrate and structural requirements of the installation. The fourth hole 96 may include countersunk or counterbored features to allow fastener heads to sit flush with the surface of the eighth plate 94, maintaining a finished appearance and preventing interference with adjacent components during sliding operations of the adjustable vent cover assembly 10.

The tongue-and-groove configuration comprises a projecting tongue formed along one edge of a first leaf that fits within a corresponding groove formed along an edge of an adjacent second leaf. The tongue is formed as a raised ridge or projection that extends outward from the leaf frame, while the groove is formed as a recessed channel or slot that receives the tongue during sliding engagement. The tongue-and-groove interface provides both sliding guidance and retention, with the tongue sliding along the length of the groove during dimensional adjustment while preventing separation between adjacent leaves. The dovetail joint configuration comprises angled engagement surfaces formed on adjacent leaves, with a dovetail projection on one leaf fitting within a corresponding dovetail recess on an adjacent leaf. The angled surfaces are oriented at approximately 15 to 45 degrees from vertical to provide mechanical retention while allowing sliding movement along the joint axis. The dovetail geometry creates a wedge-like engagement that becomes tighter under load, providing enhanced retention characteristics compared to straight-sided engagement surfaces.

In addition, the fourth leaf 20 includes a third border clip 98 and a fourth border clip 100. The third border clip 98 is positioned at the seventh plate 92, and the fourth border clip 100 is positioned at the eighth plate 94. Each of the third border clip 98 and the fourth border clip 100 may be formed from steel sheet material through stamping, cutting, or machining operations. The manufacturing processes create a clip geometry that provides appropriate engagement characteristics with corresponding rail structures on adjacent leaves. Each of the third border clip 98 and the fourth border clip 100 may be attached to the fourth frame 90 through welding to provide permanent attachment and structural continuity between the clip component and the fourth leaf 20 structure. Each of the third border clip 98 and the fourth border clip 100 may alternatively be attached through riveting, crimping, or integral formation as alternatives to welding. Each of the third border clip 98 and the fourth border clip 100 creates a mechanical interface that constrains sliding movement to predetermined vectors while preventing unwanted displacement or separation from adjacent leaf components. Each of the third border clip 98 and the fourth border clip 100 engages with corresponding rail structures in a channel-like relationship that allows smooth linear movement along the rail direction while restricting movement in other directions. Each of the third border clip 98 and the fourth border clip 100 provides structural guidance that maintains proper alignment between the fourth leaf 20 and adjacent leaves during dimensional adjustment operations of the adjustable vent cover assembly 10.

The fourth leaf 20 includes a fourth mesh panel 102 that provides filtration functionality for the adjustable vent cover assembly 10. The fourth mesh panel 102 is secured within the fourth frame 90 and allows controlled airflow passage while blocking unwanted materials such as debris, insects, or embers from entering through the vent opening. The fourth mesh panel 102 includes all the features and operates similar to mesh panels described above.

Further, the fourth leaf 20 includes a fourth back frame 104 that provides structural support for the fourth mesh panel 102 and enhances the overall rigidity of the fourth leaf 20. The fourth back frame 104 is positioned at the rear of the fourth leaf 20 assembly and creates additional structural reinforcement that maintains dimensional stability during sliding operations and environmental conditions. The fourth back frame 104 functions as a support structure that supports the fourth mesh panel 102 and distributes mechanical loads across the fourth leaf 20 structure.

The bracket attachment points comprise threaded inserts, mounting tabs, or mechanical interfaces that accept separate bracket hardware designed for specific installation requirements. The bracket attachment points are positioned at strategic locations around the assembly perimeter to provide balanced load distribution and accommodate various bracket configurations. The brackets comprise L-shaped mounting brackets, adjustable standoff brackets, or custom mounting hardware that interfaces with the attachment points through threaded fasteners, snap-fit engagement, or mechanical clamping. The bracket approach allows the assembly to be mounted at varying distances from the vent opening, accommodate irregular mounting surfaces, or provide easy removal for maintenance operations. The bracket hardware incorporates adjustment features such as slotted mounting holes, telescoping elements, or pivoting joints that accommodate minor misalignments or dimensional variations in the mounting substrate while maintaining secure attachment of the assembly.

Furthermore, the fourth leaf 20 includes a sixth rail 106 positioned at the top of the fourth back frame 104, as can be seen from FIG. 8. The sixth rail 106 functions as a mechanical constraint that enables controlled sliding movement between the fourth leaf 20 and adjacent leaf components in the adjustable vent cover assembly 10.

Figure 10A:
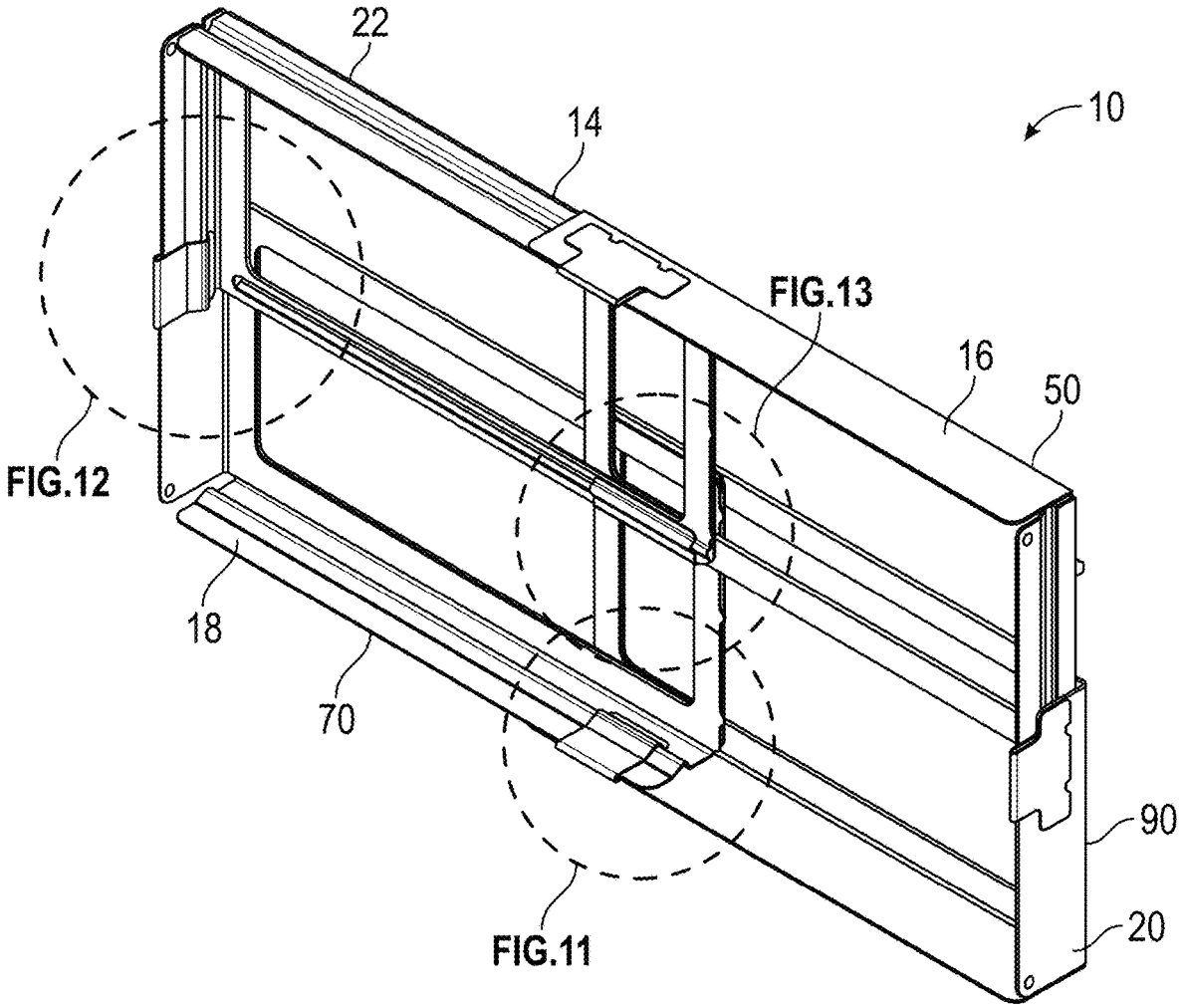
FIG. 10A and FIG. 10B illustrate a front perspective view and a rear view, respectively of the adjustable vent cover assembly, in accordance with one embodiment of the present invention.
Figure 10B:
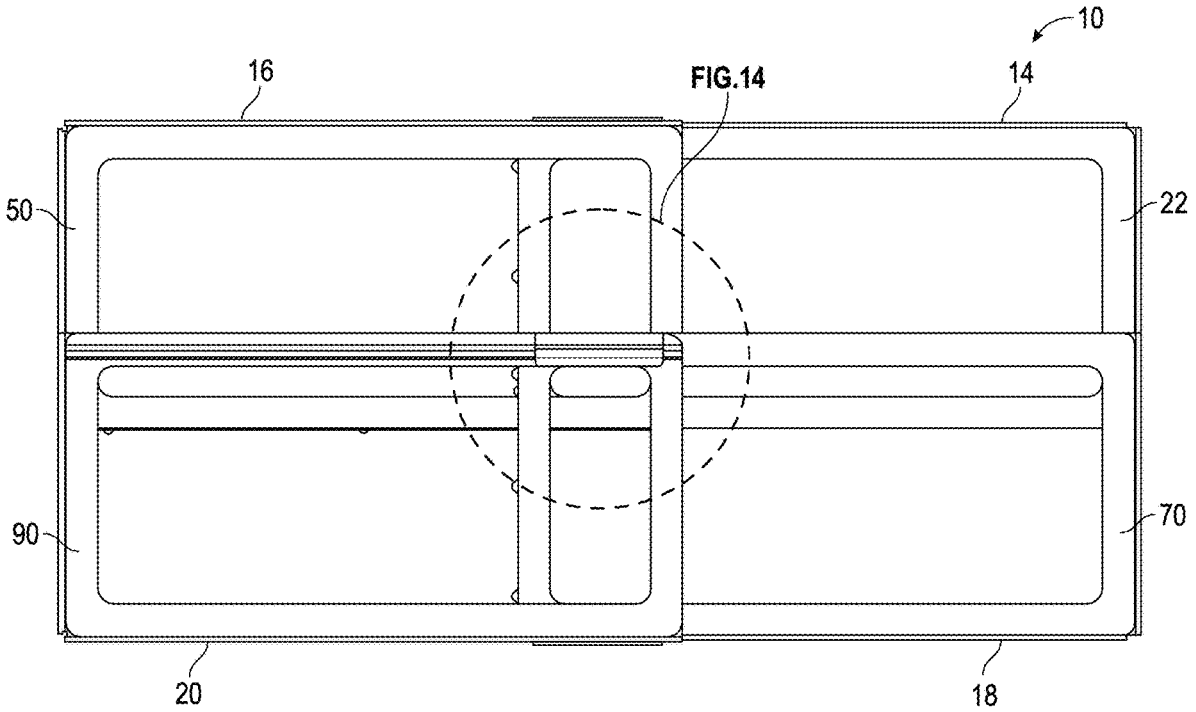

Now referring to FIG. 10A and FIG. 10B, a perspective view and a rear view, respectively of the adjustable vent cover assembly 10 is shown. It should be understood that in FIG. 10A and FIG. 10B, the mesh panels and the back panels are not shown for improved readability of the features and to showcase the connecting features of the adjustable vent cover assembly 10. The adjustable vent cover assembly 10 configuration allows the individual leaf components to interact through controlled sliding interfaces that maintain structural alignment while providing dimensional adjustability in both width and height directions.

The first leaf 14 and second leaf 16 are arranged in the upper portion of the adjustable vent cover assembly 10, while the third leaf 18 and fourth leaf 20 are positioned in the lower portion. This arrangement creates a cross-sliding configuration where adjacent leaf components slide relative to one another along perpendicular vectors to achieve dimensional adjustment capabilities. The overlapping arrangement of the first leaf 14, second leaf 16, third leaf 18 and fourth leaf 20 maintains complete coverage of the vent opening throughout the adjustment range while enabling controlled expansion and contraction operations. After placing the leaves in their overlapping configuration, the guiding system components engage to create the sliding mechanism that enables dimensional adjustment of the adjustable vent cover assembly 10.

Figure 11:
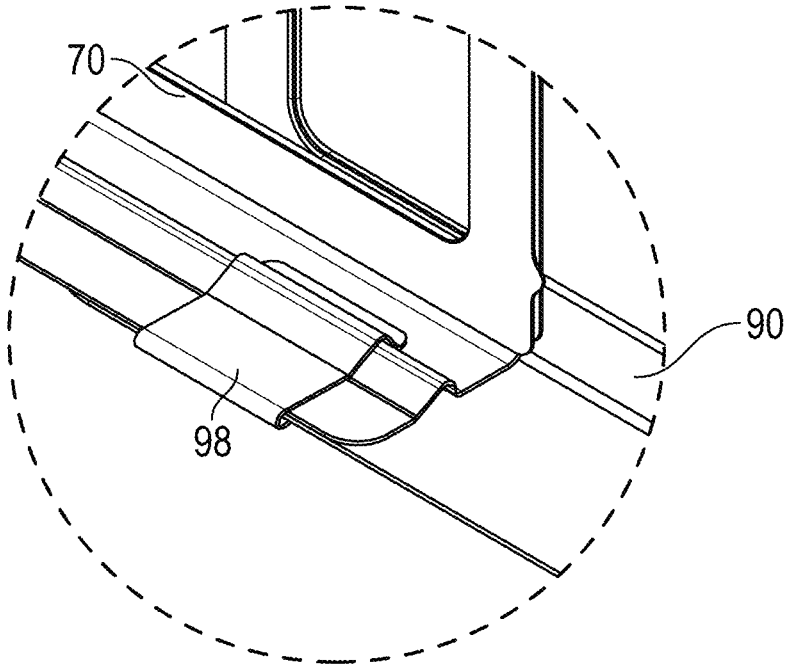
FIG. 11, FIG. 12, FIG. 13, and FIG. 14 illustrate enlarged views of the clips engaging the leaves, in accordance with one embodiment of the present invention. according to an embodiment.
Figure 12:
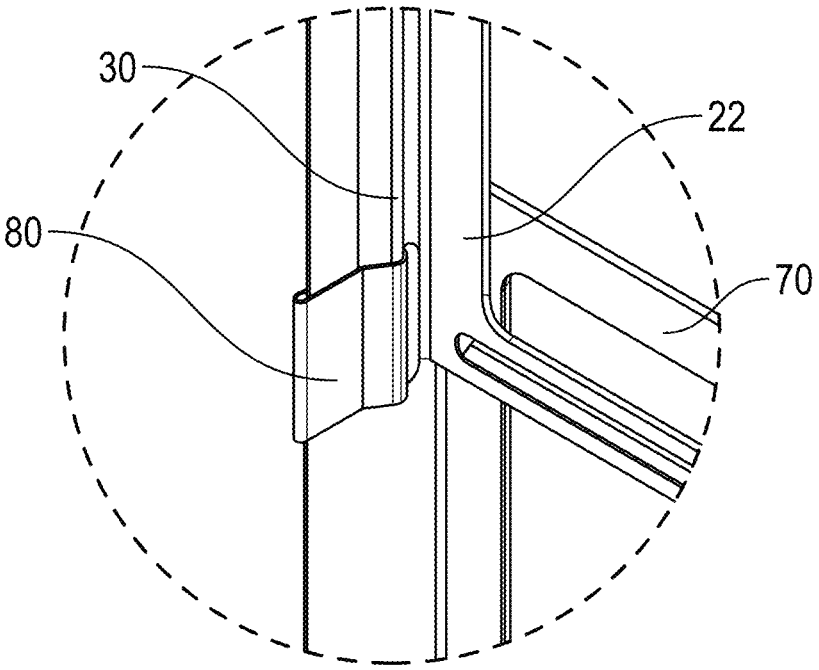
Figure 13:
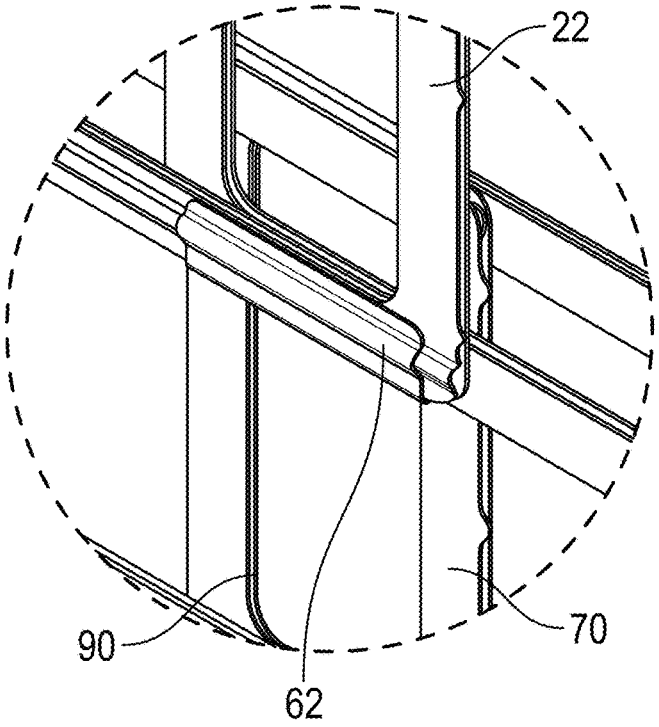
Figure 14:
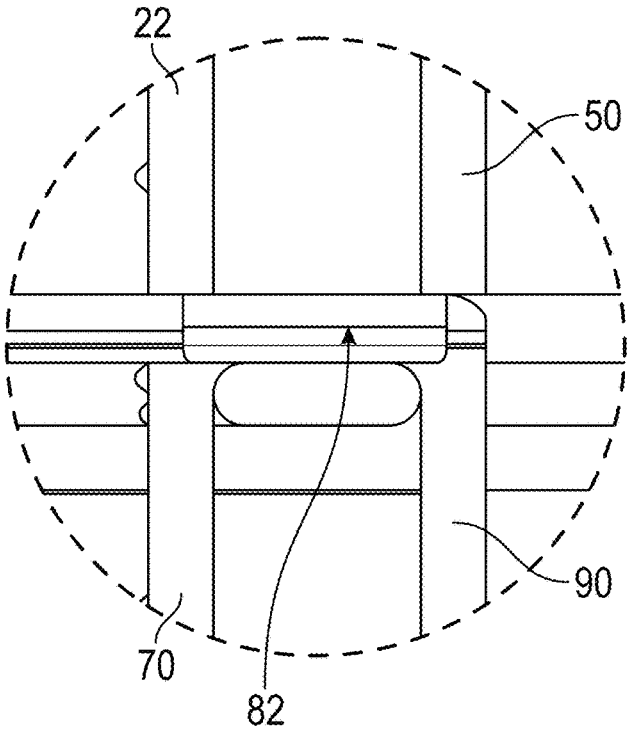

FIG. 11, FIG. 12, and FIG. 13 show enlarged views of connection details from FIG. 10A, while FIG. 14 shows an enlarged view from FIG. 10B. These figures illustrate the specific engagement interfaces between adjacent leaves that enable the sliding functionality while maintaining proper alignment throughout the adjustment range. Specifically, FIG. 11 shows an enlarged view of the third border clip 98 clamping the fifth rail 76 for connecting the third leaf 18 and fourth leaf 20. The third border clip 98 acts as a clamp and sliding guide at the bottom of the third frame 70 (third leaf 18) and fourth frame 90 (fourth leaf 20). FIG. 12 shows an enlarged view of the second border clip 80 clamped at the second rail 30. The second border clip 80 acts as a clamp and sliding guide for the first frame 22 (of first leaf 14) and third frame 70 (third leaf 18). Similarly, the fourth border clip 100 is connected to the fourth frame 90 (of fourth leaf 20) and the second frame 50 (of second leaf 16). FIG. 13 shows an enlarged view of the first center clip 62 connecting at the intersection of the first frame 22 (of first leaf 14) and the second frame 50 (second leaf 16). The first center clip 62 provides additional structural support and guidance during sliding operations, distributing mechanical loads across multiple frame components while maintaining proper alignment between adjacent leaves. FIG. 14 shows the feature of the second center clip 82 connecting third frame 70 (third leaf 18) and fourth frame 90 (fourth leaf 20) at the back of adjustable vent cover assembly 10.

The assembly process involves positioning the leaves so that the clips on each leaf engage with the corresponding rails on adjacent leaves. The first border clip 60 on the second leaf 16 engages with the first rail 28 on the first leaf 14, while the second border clip 80 on the third leaf 18 engages with the second rail 30 on the first leaf 14. Similarly, the third border clip 98 and fourth border clip 100 on the fourth leaf 20 engage with corresponding rail structures on adjacent leaves to complete the sliding mechanism. The center clips provide additional stability and guidance at intermediate positions along the frame structures, creating a distributed engagement system that maintains proper alignment throughout the entire adjustment range of the adjustable vent cover assembly 10.

Figure 17:
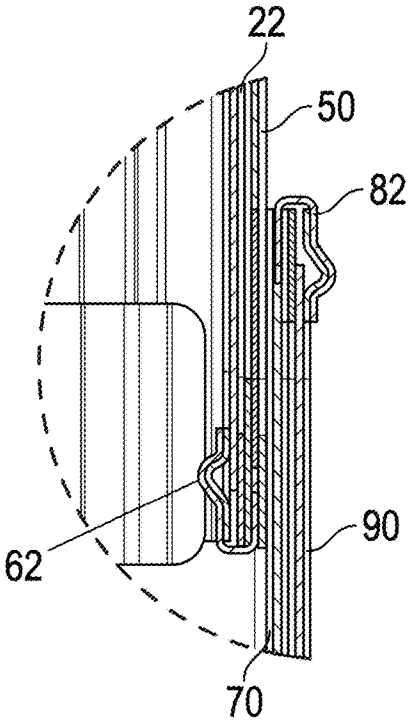
FIG. 17 shows an enlarged view of FIG. 16, according to aspects of the present disclosure.
Figure 16:
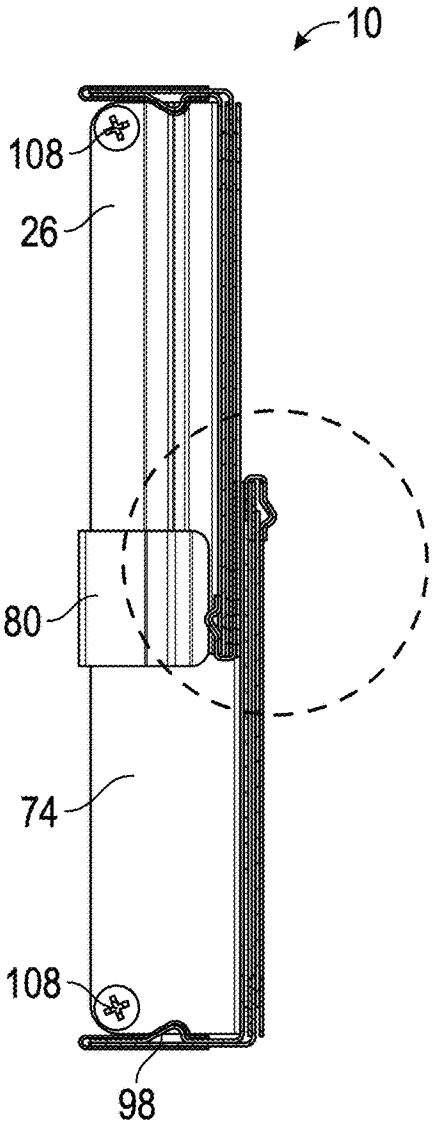
FIG. 16 shows a side cross-sectional view of the adjustable vent cover assembly shown in FIG. 15C, according to an embodiment.
Figure 15D:
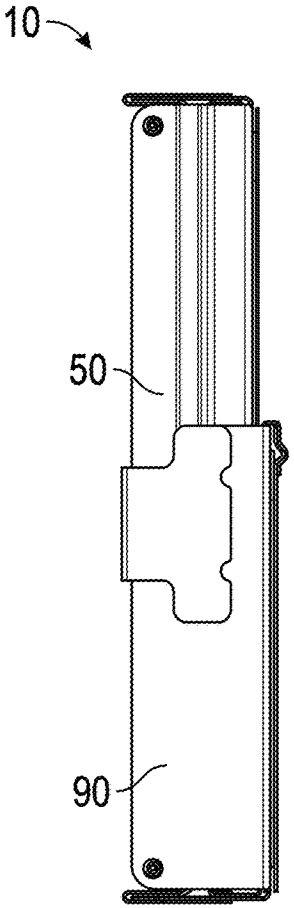

FIG. 15A, FIG. 15B, FIG. 15C, and FIG. 15D show a front perspective view, a top view, a front view, and a side view, respectively, of the adjustable vent cover assembly 10 in an expanded configuration, in accordance with one embodiment of the present invention. FIG. 16 shows a cross-section view of the adjustable vent cover assembly 10 shown in FIG. 15C. Further, FIG. 17 shows an enlarged view of the first center clip 62 and the second center clip 82 used for mounting the sliding leaves 12. In FIG. 15A, FIG. 15B, FIG. 15C, and FIG. 15D, the adjustable vent cover assembly 10 is shown to have a plurality of fasteners 108 for securing the adjustable vent cover assembly 10 to mounting surfaces. The fasteners 108 function as threaded or driven attachment elements that extend through mounting apertures i.e., holes in the frames and engage with the mounting substrate to create a secure mechanical connection. The fasteners 108 enable the adjustable vent cover assembly 10 to be permanently or removable attached to building surfaces using conventional installation methods.

The fasteners 108 may comprise various type of mechanical attachment hardware selected based on the mounting substrate material and structural requirements of the installation. The fasteners 108 may comprise wood screws that provide threaded engagement with wooden substrates such as framing lumber, plywood, or oriented strand board commonly used in building construction. The fasteners 108 may alternatively comprise sheet metal screws that provide threaded engagement with metal substrates such as steel or aluminum framing components, ductwork, or metal building panels.

The fasteners 108 may also comprise machine screws that provide threaded engagement with pre-tapped holes or threaded inserts in the mounting substrate. The machine screw configuration of the fasteners 108 may be used in applications where precise positioning and removable attachment may be desired, such as installations where the adjustable vent cover assembly 10 may need to be removed for maintenance or replacement operations. The fasteners 108 selection may be based on factors such as substrate material, load requirements, environmental conditions, and installation accessibility.

Referring back to FIG. 15A, FIG. 15B, FIG. 15C, and FIG. 15D, the adjustable vent cover assembly 10 may be configured to enable sliding motion between the sliding leaves 12 to provide dimensional adjustability in both width and height directions. The sliding leaves 12 may be arranged to overlap with one another in a manner that allows controlled sliding movement while maintaining complete coverage of the vent opening throughout the adjustment range. The sliding motion may occur along perpendicular vectors, with some sliding leaves 12 controlling width expansion and other sliding leaves 12 controlling height expansion to achieve two-dimensional adjustability.

The cross-sliding configuration involves positioning the sliding leaves 12 so that adjacent leaves slide relative to one another along different directional axes. In some cases, a first pair of leaves comprising the first leaf 14 and second leaf 16 slides vertically to control the height dimension of the assembly, while a second pair of leaves comprising the third leaf 18 and fourth leaf 20 slides horizontally to control the width dimension. The overlapping arrangement allows the sliding leaves 12 to nest together when the assembly is in a contracted state, with the leaves extending outward from one another when the assembly is expanded to cover larger opening dimensions.

Figure 18A:
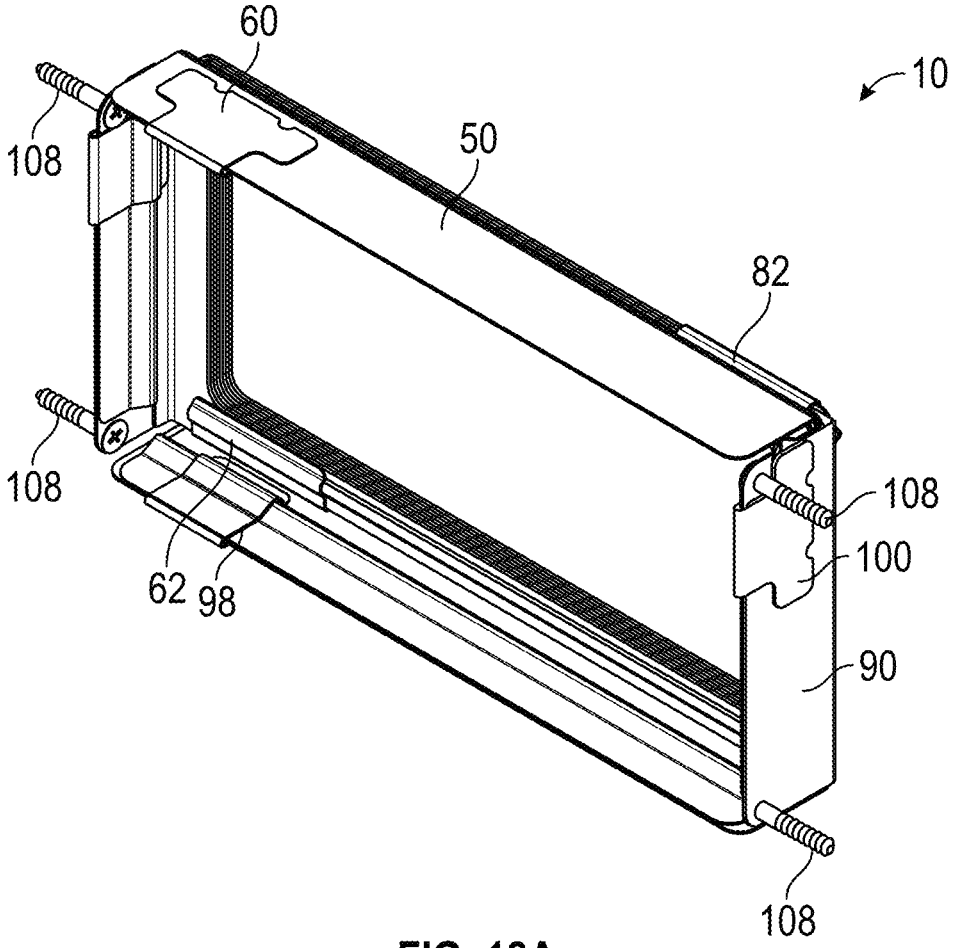
FIG. 18A, FIG. 18B, FIG. 18C, and FIG. 18D illustrate a perspective view, a top view, a front view, and a side view, respectively of the adjustable vent cover assembly in a contracted configuration, in accordance with one embodiment of the present invention.
Figure 18B:
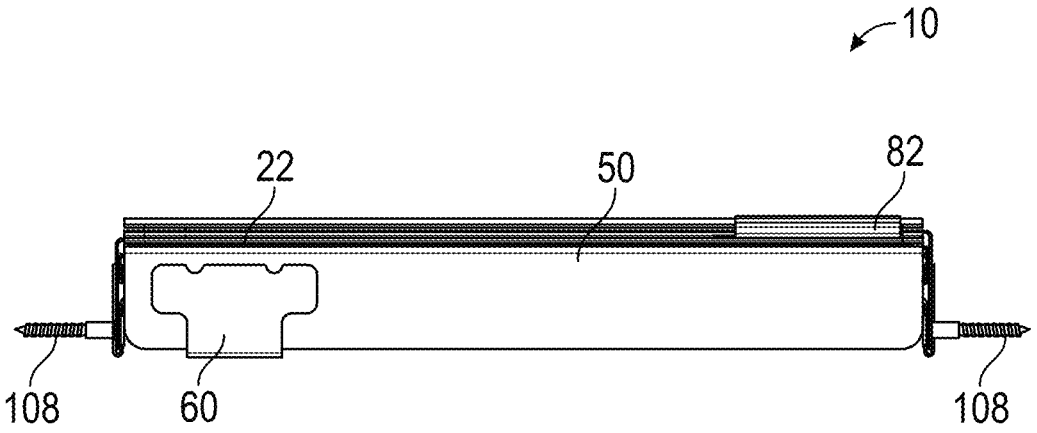
Figure 18C:
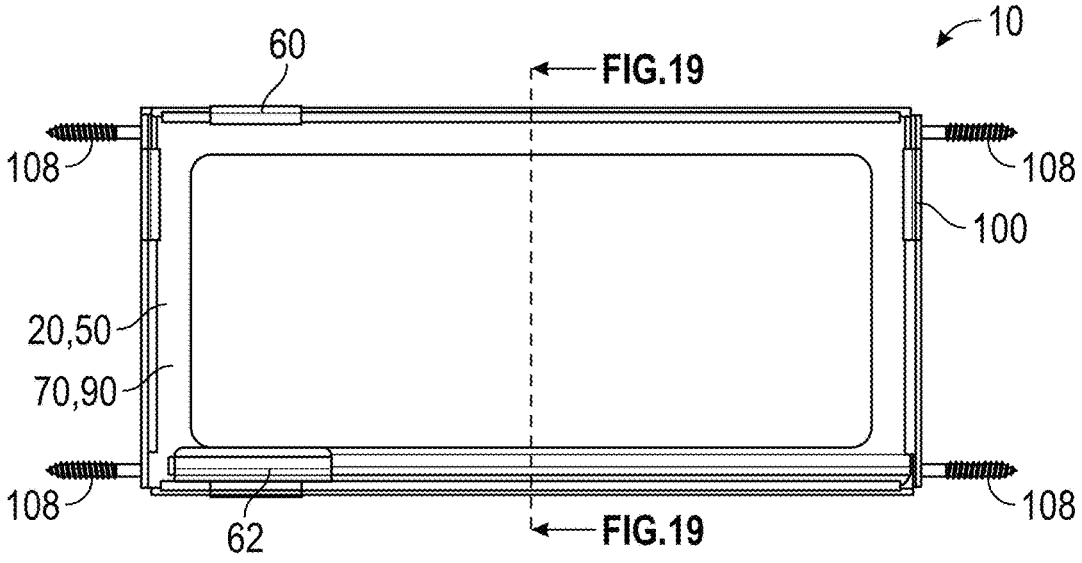
Figure 18D:
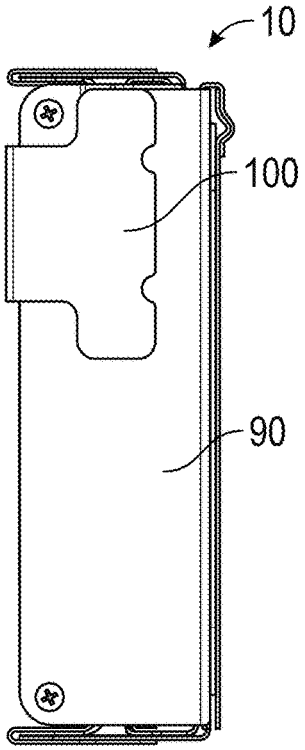
Figure 19:
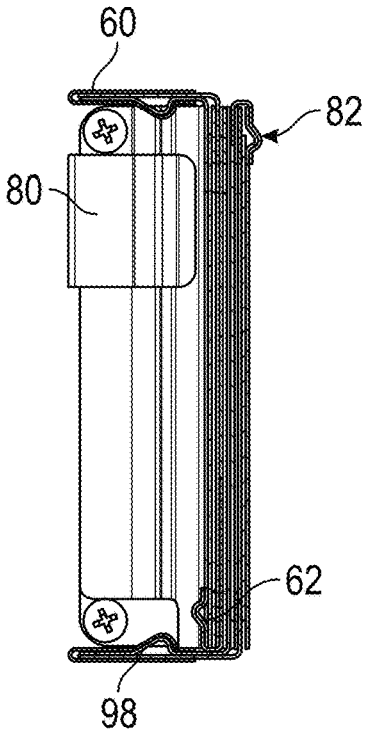
FIG. 19 illustrates a side cross-sectional view of the adjustable vent cover assembly shown in FIG. 18C, according to an embodiment.

With continued reference to FIG. 15A, FIG. 15B, FIG. 15C, and FIG. 15D, the adjustable vent cover assembly 10 may be configured to expand from a contracted state where the sliding leaves 12 overlap substantially to an expanded state with expansion ranges allowing coverage from approximately 10×5 inches to approximately 17×8 inches. FIG. 18A, FIG. 18B, FIG. 18C, and FIG. 18D show the adjustable vent cover assembly 10 in the contracted state, in accordance with the present invention. Further, FIG. 19 shows a cross-sectional view of the FIG. 18C illustrating stacking of panels i.e., frames, mesh panels and back panels at the back of the adjustable vent cover assembly 10. The contracted state may represent the minimum dimensions of the adjustable vent cover assembly 10 when the sliding leaves 12 are positioned with maximum overlap. In the contracted state, each leaf may extend beyond the edges of adjacent leaves by a minimal amount to maintain structural continuity and complete coverage. The expanded state may represent the maximum dimensions achievable when the leaves are slid to their furthest positions relative to one another.

The range of dimensional adjustment may vary based on the specific design parameters of the leaves and the extent of sliding motion permitted by the assembly configuration. In some cases, the width adjustment range may span from approximately 10 inches to approximately 17 inches, providing a 7-inch adjustment capability. The height adjustment range may span from approximately 5 inches to approximately 8 inches, providing a 3-inch adjustment capability. These adjustment ranges may allow a single assembly to accommodate multiple standard vent opening sizes without requiring modification of the opening or selection of different cover sizes.

The sliding motion between sliding leaves 12 may be constrained to maintain proper alignment and prevent separation during adjustment operations. As shown in FIG. 15A, FIG. 15B, FIG. 15C, and FIG. 15D, the adjustable vent cover assembly 10 may incorporate a guiding system (rails) configured to constrain sliding motion of the sliding leaves 12 to maintain alignment between adjacent sliding leaves 12 during expansion and contraction of the adjustable vent cover assembly 10 in two perpendicular dimensions. The guiding system (rails) may prevent the sliding leaves 12 from sliding in unintended directions or separating from one another during adjustment, ensuring that the adjustable vent cover assembly 10 maintains structural integrity throughout the adjustment range.

The perpendicular sliding vectors may be achieved through the geometric arrangement of the sliding leaves 12 and the configuration of the guiding system components. Each leaf may be constrained to slide along a single linear vector relative to its adjacent leaves, with the vectors for different leaf pairs oriented at approximately 90-degree angles to one another. This perpendicular arrangement may allow independent adjustment of width and height dimensions, enabling the adjustable vent cover assembly 10 to be configured to match rectangular vent openings of various proportions within the overall adjustment range.

The adjustable vent cover assembly 10 utilizes a clip-and-rail guiding system i.e., border clips, and center clips (clips), and the rails (guiding system). The clip-and-rail guiding system constrains sliding motion of the leaves to linear vectors and maintains alignment between adjacent leaves. The clip-and-rail guiding system may provide structural control over the sliding movement between overlapping leaves, preventing unwanted separation, wobbling, or misalignment during adjustment operations. The guiding system may be configured to allow smooth linear movement along predetermined vectors while restricting movement in other directions that could compromise the structural integrity or coverage capability of the adjustable vent cover assembly 10. As specified above, the clip-and-rail guiding system includes clips secured to a first leaf and rails formed by bent lateral flanges in a frame of an adjacent second leaf. The clips may be formed of steel elements that provide mechanical engagement with corresponding rail structures on adjacent leaves. The clips may be secured to the first leaf through various attachment methods including welding, riveting, crimping, or integral formation as part of the leaf frame structure. In some cases, the clips may be welded to the first leaf to provide permanent attachment and structural continuity between the clip components and the leaf frame. The welding process may create a metallurgical bond that distributes mechanical loads across the joint interface, potentially reducing stress concentrations that could lead to failure during repeated adjustment cycles. Alternative attachment methods such as riveting or crimping may provide mechanical fastening that allows for field replacement or repair of individual clips if needed.

The rails may be formed by bent lateral flanges in the frame of the adjacent second leaf, creating channel-like structures that receive and guide the clips during sliding movement. The rails may alternatively comprise grooves, track-like structures, or other guiding formations that provide mechanical constraint for the sliding motion. The bent lateral flanges may be formed through metal forming processes such as bending, rolling, or stamping that create raised edges or channels along the perimeter or interior surfaces of the leaf frame. The rail geometry may be configured to provide sufficient clearance for smooth sliding movement while maintaining close tolerances that prevent excessive play or looseness between the interacting components. The bent lateral flanges may extend along portions of the leaf frame where sliding contact with adjacent leaves occurs, providing continuous guidance throughout the adjustment range.

Each clip may engage a corresponding rail in a channel-like relationship to constrain movement to a single linear direction. The channel-like relationship may involve the clip component fitting within or around the rail structure in a manner that allows sliding movement along the length of the rail while preventing movement perpendicular to the rail direction. The engagement between the clip and rail may create a mechanical constraint that guides the sliding motion along a predetermined vector, maintaining proper alignment between adjacent leaves throughout the adjustment process. The channel-like relationship may also provide retention forces that prevent the leaves from separating during handling or installation operations.

The clip-and-rail system may employ at least six clips distributed along interacting leaves to provide adequate guidance and support for the sliding mechanism. The distribution of multiple clips along the leaf interfaces may help distribute mechanical loads and provide redundant guidance points that maintain alignment even if individual clips experience wear or slight deformation. The clips may be positioned at strategic locations along the leaf perimeters or interior surfaces where maximum guidance effectiveness can be achieved. In some cases, the clips may be spaced at regular intervals along the sliding interface, while in other cases the clip positioning may be optimized based on the anticipated load distribution and sliding dynamics of the particular leaf configuration.

The clip-and-rail guiding system may provide several functional advantages over unguided sliding arrangements. The mechanical constraint provided by the clip-and-rail engagement may prevent the leaves from binding or jamming during adjustment operations, particularly when the adjustable vent cover assembly 10 is expanded to near-maximum dimensions where the overlap between adjacent leaves may be minimal. The guided sliding motion may also help maintain consistent gap spacing between adjacent leaves, ensuring that the adjustable vent cover assembly 10 maintains proper coverage without creating openings that could allow unwanted material passage. The structural connection provided by the clip-and-rail system may also contribute to the overall rigidity of the adjustable vent cover assembly 10 when installed, reducing vibration or movement that could occur due to airflow forces or external disturbances.

Alternative guiding mechanisms may be employed in place of the clip-and-rail system depending on manufacturing preferences, material constraints, or specific application requirements. In some cases, the guiding mechanism may use tongue-and-groove joints instead of the clip-and-rail system. Tongue-and-groove joints may involve complementary projections and recesses formed along the edges of adjacent leaves, with the tongue portion of one leaf fitting within the groove portion of an adjacent leaf to provide sliding guidance. The tongue-and-groove configuration may be formed through machining, molding, or forming processes that create the interlocking geometry as an integral part of the leaf frame structure.

In other cases, the guiding mechanism may use sliding tracks instead of the clip-and-rail system. Sliding tracks may comprise separate track components that are attached to or integrated with the leaf frames, with corresponding slider elements that move within the track channels during adjustment operations. The sliding track configuration may allow for more complex guidance geometries or may accommodate different materials or manufacturing processes compared to the clip-and-rail approach. The track components may be formed from materials selected for low friction and wear resistance, potentially incorporating bearing surfaces or lubricating features to enhance sliding performance.

In additional cases, the guiding mechanism may use dovetail joints instead of the clip-and-rail system. Dovetail joints may involve angled or tapered engagement surfaces that provide mechanical retention while allowing sliding movement along the joint axis. The dovetail configuration may create a wedge-like engagement that prevents separation between adjacent leaves while maintaining the ability to slide relative to one another during adjustment operations. The dovetail geometry may be formed through machining or forming processes that create the angled surfaces with appropriate tolerances to achieve the desired sliding characteristics and retention forces.

Manufacturing details for the clip-and-rail guiding system may involve specific fabrication processes that ensure proper dimensional tolerances and structural integrity. The clips may be formed from steel sheet material through stamping, cutting, or machining operations that create the desired geometric profile for engagement with the rail structures. The clips may be welded to the first leaf using resistance welding, arc welding, or other joining processes that create a metallurgical bond between the clip material and the leaf frame. The welding process may be performed at predetermined locations along the leaf perimeter or interior surfaces, with weld parameters selected to provide adequate joint strength while minimizing heat-affected zone distortion that could affect dimensional accuracy.

The rails may be formed by bending lateral flanges in the frame of the adjacent second leaf through metal forming processes such as brake forming, roll forming, or press forming that create the channel-like geometry required for clip engagement. The bending operations may be performed using tooling designed to achieve consistent bend angles and radii that provide proper clearance for sliding motion while maintaining close tolerances that prevent excessive play between the interacting components. The bent lateral flanges may be formed with specific dimensional relationships to the clip geometry, ensuring smooth sliding motion throughout the adjustment range while providing adequate retention forces to prevent unwanted separation.

Mounting Features and Installation Options

The adjustable vent cover assembly 10 may incorporate mounting features (e.g., plates 24, 26, 52, 54, 72, 74, 92, and 94) that provide versatility in installation methods and accommodate various architectural configurations and construction scenarios. The mounting features may be selected from multiple options to match the specific requirements of different installation environments, building materials, and accessibility constraints that installers may encounter in residential and commercial applications for exterior openings in crawl-spaces and attics. The availability of multiple mounting approaches may allow the adjustable vent cover assembly 10 to be installed using standard tools and techniques commonly employed in the field without requiring specialized equipment or modification of existing installation practices.

The mounting features may include a front flange extending outward from a perimeter of the assembled leaves. The front flange may comprise a continuous or segmented rim structure that extends beyond the outer edges of the leaf adjustable vent cover assembly 10 to create an overlapping interface with the surface surrounding the vent opening. The front flange may be formed as an integral part of one or more leaf frames, or the front flange may comprise separate components that are attached to the assembled leaves during manufacturing or installation. The front flange configuration may provide a surface mounting approach where the flange rests against the wall, ceiling, or floor surface surrounding the vent opening, creating a finished appearance that conceals the edges of the opening and provides a secure attachment interface.

The front flange may be dimensioned to provide adequate overlap with the mounting surface while maintaining proportional aesthetics relative to the overall assembly dimensions. In some cases, the front flange may extend approximately 0.5 to 1.5 inches beyond the perimeter of the assembled leaves to provide sufficient bearing surface for attachment and load distribution. The front flange may incorporate reinforcement features such as ribs, channels, or increased material thickness in areas where mounting loads may be concentrated. The flange surface may include provisions for gaskets, weatherstripping, or sealing materials to enhance the interface between the adjustable vent cover assembly 10 and the mounting surface, particularly in applications where air leakage control may be desired.

The mounting features may also include holes (e.g., holes 34, 58, 78, and 96) or apertures for mechanical fasteners 108 that allow the adjustable vent cover assembly 10 to be secured using screws, bolts, nails, or other threaded or driven fasteners. The holes may be positioned at strategic locations around the perimeter of the adjustable vent cover assembly 10 or within the front flange (plate) structure to provide balanced load distribution and secure attachment. The holes may be sized to accommodate common fastener diameters used in installation applications for exterior vents, such as 8 or 10 wood screws, sheet metal screws, or machine screws depending on the mounting substrate and structural requirements. The holes may include countersunk or counterbored features to allow fastener heads to sit flush with or below the surface of the adjustable vent cover assembly 10, maintaining a finished appearance and preventing interference with adjacent components.

The holes may be positioned to avoid interference with the sliding mechanism of the sliding leaves 12 while providing adequate structural support for the installed adjustable vent cover assembly 10. In some cases, the holes may be located in fixed portions of the leaf frames that do not move during adjustment operations, ensuring that the fastener locations remain consistent regardless of the assembly configuration. The holes may also be positioned to align with standard mounting hole patterns or spacing commonly used in vent cover applications, allowing the adjustable vent cover assembly 10 to be installed in locations where previous fixed-dimension covers were mounted without requiring new fastener holes.

Adhesive mounting surfaces may be incorporated as an alternative mounting approach that eliminates the need for mechanical fasteners in certain applications. The adhesive mounting surfaces may comprise designated areas on the front flange or leaf frames where pressure-sensitive adhesive strips, double-sided tape, or liquid adhesive compounds may be applied to create a bonded interface with the mounting surface. The adhesive mounting approach may be particularly suitable for temporary installations, rental properties, or situations where drilling holes for mechanical fasteners may not be permitted or practical.

The adhesive mounting surfaces may be configured with appropriate surface textures, cleaning provisions, or primer compatibility to enhance adhesive bond strength and longevity. In some cases, the mounting surfaces may include raised or recessed features that help position adhesive strips or provide mechanical interlocking with textured adhesive materials. The surface finish in adhesive mounting areas may be selected to promote adhesive compatibility while maintaining corrosion resistance and durability under typical environmental conditions. The adhesive mounting approach may also incorporate removable or repositionable adhesive systems that allow the adjustable vent cover assembly 10 to be relocated or removed without damaging the mounting surface.

Bracket attachment points may provide additional mounting flexibility by allowing the adjustable vent cover assembly 10 to be secured using separate bracket hardware that may be customized for specific installation requirements. The bracket attachment points may comprise threaded inserts, mounting tabs, or other mechanical interfaces that accept separate bracket components designed to interface with particular mounting substrates or architectural configurations. The bracket approach may be particularly useful in applications where the adjustable vent cover assembly 10 must be mounted at a distance from the vent opening, where the mounting surface may be irregular or non-planar, or where the adjustable vent cover assembly 10 may need to be easily removable for maintenance or cleaning operations.

The bracket attachment points may be positioned to provide multiple mounting orientations or configurations, allowing the same assembly to be installed in horizontal, vertical, or angled orientations depending on the vent opening location and accessibility requirements. The bracket hardware may incorporate adjustment features that accommodate minor misalignments or dimensional variations in the mounting substrate, providing installation tolerance that may simplify field installation procedures. The bracket attachment approach may also allow the assembly to be pre-positioned and aligned before final securing, potentially reducing installation time and improving the accuracy of the final installation.

The combination of multiple mounting feature options may provide installers with flexibility to select the most appropriate attachment method based on the specific conditions encountered at each installation site. The mounting features may be designed to accommodate different building materials such as drywall, wood framing, masonry, metal surfaces, or composite materials commonly found in residential and commercial construction. The versatility in mounting approaches may also allow the same assembly design to be used in different applications such as wall-mounted, ceiling-mounted, or floor-mounted installations without requiring separate product variants or specialized mounting hardware.

Advanced Features and Alternative Embodiments

The adjustable vent cover assembly 10 may incorporate advanced filtration capabilities that extend beyond basic debris blocking to provide enhanced safety and performance characteristics in specialized applications. These advanced features may be particularly beneficial in environments where fire safety, ember protection, or multi-stage particle filtration may be desired. The modular design of the leaf structure may accommodate various filtration technologies while maintaining the dimensional adjustability and structural integrity of the basic assembly configuration.

In some cases, the adjustable vent cover assembly 10 may include a multi-stage filtration system (mesh panels) that incorporates multiple filtration layers within each leaf structure. The multi-stage filtration system may comprise a large debris mesh as a first filtration stage, positioned to intercept larger particles, leaves, insects, and other substantial materials that could obstruct airflow or enter the building. The large debris mesh may comprise relatively coarse mesh material with openings sized to block materials larger than approximately 0.25 to 0.5 inches while allowing unrestricted airflow for normal ventilation. The large debris mesh may be positioned as the outermost filtration layer where initial contact with airborne materials occurs.

The mesh panels are secured within the rigid frames through a sandwich construction where the mesh is positioned between the frame and the back frame. The mechanism securing the frame to the back frame, whether through welds, rivets, adhesive, clips, or integrated metal bends pressing the two components together, simultaneously secures the mesh in position between them. The pressure applied upon the mesh by both the frame and the back frame produces static friction that holds the mesh securely in position during handling, installation, and service conditions. This sandwich construction maintains proper mesh tension and alignment within the frame structure while providing distributed retention forces around the mesh perimeter. Alternatively, the mesh panels may be secured within channels or grooves using crimping operations that mechanically deform portions of the frame material to capture and retain the mesh edges. The crimping process involves forming tools that create localized deformation of the frame material around the mesh perimeter, creating mechanical retention that prevents mesh displacement. The crimping operations may be performed at regular intervals around the mesh perimeter to provide distributed retention forces, with the crimp geometry selected to maintain proper mesh tension while preventing damage to the mesh material during the forming process.

The guiding system may provide performance benefits that enhance the functional operation of the adjustable vent cover assembly during both adjustment and service conditions. The mechanical constraint provided by the guiding system may ensure consistent airflow characteristics when the assembly is adjusted to different dimensional configurations, maintaining proper air passage rates and pressure drop characteristics across the full range of expansion settings. The guided sliding motion may prevent the formation of gaps or misalignments between adjacent leaves that could create bypass paths for unwanted materials, ensuring that the filtration effectiveness remains consistent regardless of the assembly configuration.

The structural alignment maintained by the guiding system may prevent bypass of embers between sliding leaves, particularly in applications where fire safety may be a concern. The close tolerances and continuous engagement provided by the clip-and-rail system May eliminate gaps that could allow small burning particles to pass through the interface between adjacent leaves, maintaining the ember-blocking effectiveness of the assembly throughout the adjustment range. The mechanical retention forces provided by the guiding system may also prevent wind-induced movement or vibration that could create temporary gaps or misalignments during high-airflow conditions or external disturbances.

The guided sliding mechanism may also provide enhanced durability and service life compared to unguided adjustable systems by preventing binding, jamming, or excessive wear that could occur from misaligned sliding motion. The controlled movement paths established by the guiding system may distribute wear forces evenly across the sliding interfaces, reducing localized stress concentrations that could lead to premature failure or degraded performance. The mechanical constraints may also prevent over-extension or forced movement that could damage the sliding components, ensuring reliable operation throughout the intended service life of the assembly.

The multi-stage filtration system may incorporate an intumescent fire barrier as a second filtration stage positioned behind the large debris mesh within the leaf structure. The intumescent fire barrier may comprise materials that expand when exposed to elevated temperatures, creating a sealed barrier that may help prevent fire spread through the vent opening. The intumescent materials may be formulated to activate at predetermined temperature thresholds, such as 200° F. to 400° F., depending on the specific fire protection requirements of the application. The intumescent fire barrier may be configured as a sheet material, coating, or formed component that integrates with the leaf frame structure while maintaining airflow capability under normal operating conditions.

The intumescent fire barrier may provide passive fire protection by automatically responding to temperature increases without requiring external activation or control systems. When exposed to fire conditions, the intumescent materials may expand to multiple times their original thickness, creating a char layer that insulates the vent opening and may help prevent flame penetration or heat transfer through the assembly. The expansion characteristics of the intumescent materials may be selected to provide appropriate response time and barrier thickness based on the specific fire rating requirements of the building or application. The intumescent fire barrier may maintain structural integrity during expansion to prevent fragmentation or displacement that could compromise the protective barrier.

A small ember filter may comprise a third filtration stage positioned as the innermost layer of the multi-stage filtration system. The small ember filter may comprise fine mesh material with openings sized to intercept small burning particles, sparks, or embers that could pass through the larger mesh stages. The small ember filter may utilize mesh openings in the range of 0.05 to 0.1 inches to provide effective ember blocking while maintaining acceptable airflow resistance for proper ventilation. The ember filter material may be selected for fire resistance and structural stability when exposed to elevated temperatures or direct contact with burning particles.

The small ember filter may be particularly beneficial in wildfire-prone areas where wind-blown embers may pose a risk of entering buildings through vent openings and igniting interior materials. The fine mesh construction of the ember filter may create a barrier that allows normal airflow while preventing ember penetration, potentially reducing the risk of structure ignition from external fire sources. The ember filter material may comprise stainless steel, bronze, or other fire-resistant alloys that maintain structural integrity and filtration effectiveness when exposed to high temperatures or direct flame contact.

The integration of multiple filtration stages within the adjustable leaf structure may be accomplished through layered construction techniques that maintain the sliding functionality while accommodating the additional filtration components. Each leaf may incorporate mounting channels, retention clips, or adhesive bonding systems that secure the multiple filtration layers in proper alignment and spacing. The spacing between filtration layers may be optimized to prevent interference between adjacent layers while maintaining compact overall thickness that does not compromise the sliding mechanism or dimensional adjustability of the assembly.

The multi-stage filtration system may be configured as a modular assembly where individual filtration stages may be replaced or upgraded independently without requiring replacement of the entire vent cover assembly. The modular approach may allow building owners to adapt the filtration capabilities based on changing environmental conditions, regulatory requirements, or maintenance schedules. The filtration stages may be designed with standardized mounting interfaces that accommodate different filtration materials or technologies while maintaining compatibility with the existing leaf structure and sliding mechanism.

Alternative material selections for the multi-stage filtration system may provide specialized performance characteristics for particular applications or environmental conditions. The large debris mesh may comprise galvanized steel, aluminum, or polymer materials selected for corrosion resistance, weight considerations, or compatibility with specific atmospheric conditions. The intumescent fire barrier may incorporate different chemical formulations or activation temperatures based on local fire codes, building classifications, or risk assessments. The small ember filter may utilize specialized alloys or surface treatments that enhance ember blocking effectiveness or extend service life in high-exposure environments.

The multi-stage filtration system may incorporate monitoring or indication features that provide visual or electronic feedback regarding the condition or activation status of the various filtration stages. Temperature-sensitive indicators may change color or appearance when the intumescent fire barrier has been exposed to activation temperatures, providing maintenance personnel with information about potential fire exposure events. Pressure differential sensors may monitor airflow resistance across the filtration stages to indicate when cleaning or replacement may be needed to maintain optimal ventilation system performance.

The advanced filtration capabilities may be combined with enhanced mounting and sealing features that provide improved integration with building fire protection systems or emergency response procedures. The assembly may incorporate provisions for connection to building automation systems that monitor vent status or provide remote control capabilities during emergency conditions. Sealing interfaces may be enhanced to provide smoke or gas barriers that complement the fire protection capabilities of the intumescent materials, creating a comprehensive barrier system that addresses multiple aspects of building safety and environmental control.

Method of Installation

The installation of the adjustable vent cover assembly may involve a systematic approach that accommodates the dimensional flexibility and mounting versatility of the assembly while ensuring proper fit and secure attachment to the vent opening. The installation process May be designed to utilize standard tools and techniques commonly available to installers, building maintenance personnel, and homeowners, without requiring specialized equipment or extensive modification of existing vent openings. The step-by-step installation method may provide flexibility to accommodate various opening sizes, mounting surfaces, and architectural configurations encountered in residential and commercial applications.

The installation process may begin with providing the adjustable vent cover assembly 10 having a plurality of sliding leaves 12 configured to expand and contract in both width and height. The adjustable vent cover assembly 10 may be supplied in a contracted state where the leaves overlap substantially to minimize shipping dimensions and facilitate handling during transport and storage. The contracted configuration may represent the minimum dimensions of the adjustable vent cover assembly 10, with the sliding leaves 12 positioned to provide maximum overlap while maintaining structural integrity and complete coverage capability. The adjustable vent cover assembly 10 may be packaged with installation instructions, mounting hardware, and any additional components needed for typical installation scenarios.

Prior to installation, the installer may measure the dimensions of the vent opening to determine the appropriate expansion settings for the adjustable vent cover assembly. The measurement process may involve determining both the width and height dimensions of the opening, as well as assessing the mounting surface conditions and accessibility constraints that may influence the installation approach. The opening measurements may be compared to the adjustment range capabilities of the assembly to confirm compatibility and determine the extent of expansion needed to achieve proper fit. In some cases, the installer may also evaluate the depth of the vent opening and the clearance available around the perimeter to ensure adequate space for the mounting features and proper airflow characteristics.

The dimensional adjustment process may involve adjusting the dimensions of the adjustable vent cover assembly 10 to fit the vent opening through controlled sliding movement of the sliding leaves 12 relative to one another. The adjustment procedure may begin with the adjustable vent cover assembly 10 in the contracted state, where the sliding leaves 12 overlap substantially and the overall dimensions correspond to the minimum coverage area. The installer may grasp opposing leaves and apply gentle outward force to initiate sliding movement, with the sliding leaves 12 moving along predetermined vectors to increase the overall dimensions of the adjustable vent cover assembly 10. The sliding motion may be guided by the mechanical constraints built into the adjustable vent cover assembly 10, ensuring that the leaves move in proper alignment without binding or separation.

In cases where the adjustable vent cover assembly 10 comprises four leaves arranged in a cross-sliding configuration, each leaf including a rigid frame and a mesh panel secured within the frame, the adjustment process may involve independent control of width and height dimensions. The cross-sliding configuration may allow the installer to adjust width and height dimensions separately or simultaneously, depending on the specific dimensional requirements of the vent opening. The four-leaf arrangement may provide expansion capability in both horizontal and vertical directions, with two leaves controlling width expansion and two leaves controlling height expansion through perpendicular sliding vectors.

The sliding adjustment process may be facilitated by adjusting the dimensions through sliding the sliding leaves 12 relative to one another using a clip-and-rail guiding system that constrains sliding motion to linear vectors. The clip-and-rail guiding system may provide mechanical guidance that ensures smooth, controlled movement of the leaves during adjustment operations. The installer may apply force to slide the leaves along the predetermined vectors, with the clip-and-rail system preventing unwanted movement in other directions that could cause binding, misalignment, or separation between adjacent leaves. The guided sliding motion may allow precise dimensional adjustment while maintaining structural integrity throughout the expansion process.

The clip-and-rail guiding system may comprise clips secured to a first leaf and rails formed by bent lateral flanges in a frame of an adjacent second leaf, with each clip engaging a corresponding rail in a channel-like relationship. During the adjustment process, the clips may slide along the rails in the channel-like engagement, providing continuous guidance and retention as the leaves move relative to one another. The channel-like relationship may prevent the leaves from separating while allowing smooth sliding movement along the rail direction. The installer may feel the mechanical constraint provided by the clip-and-rail engagement, which may serve as tactile feedback to confirm proper sliding motion and prevent over-extension or misalignment during adjustment.

In some cases, the clip-and-rail guiding system may employ at least six clips distributed along interacting leaves with the clips being formed steel elements welded to the first leaf. The multiple clips may provide distributed guidance and support during the adjustment process, with each clip contributing to the overall stability and alignment of the sliding mechanism. The installer may observe smooth, consistent movement as the multiple clips slide simultaneously along their corresponding rails, indicating proper operation of the guiding system. The steel construction of the clips may provide durability and strength to withstand the forces applied during adjustment operations, while the welded attachment may ensure permanent retention of the clips to their respective leaves.

The dimensional adjustment may involve expanding the assembly from the contracted state where the leaves overlap substantially to an expanded state with expansion ranges allowing coverage from approximately 10×5 inches to approximately 17×8 inches. The installer may monitor the dimensions of the assembly during expansion to achieve the target dimensions that match the vent opening measurements. The expansion process may be performed gradually, with the installer checking the fit against the opening periodically to avoid over-expansion that could create excessive stress on the sliding mechanism or result in dimensions that exceed the opening size. The expansion range capability may allow the assembly to accommodate a variety of standard and non-standard opening sizes using a single adjustable unit.

In cases where the adjustable vent cover assembly 10 comprises four leaves with rigid frames formed from steel and mesh panels comprising fine metal mesh, the adjustment process may involve handling the assembly with appropriate care to prevent damage to the mesh panels or deformation of the steel frames. The installer may grasp the rigid frame portions of the leaves during adjustment operations to avoid applying force directly to the mesh panels, which could cause stretching, tearing, or detachment from the frame structure. The steel frame construction may provide sufficient strength to withstand the handling forces applied during adjustment, while the fine metal mesh may maintain proper tension and alignment as the leaves slide relative to one another.

Once the adjustable vent cover assembly 10 has been adjusted to the appropriate dimensions, the installation process may proceed with securing the assembly to cover the vent opening using various mounting approaches selected based on the specific installation conditions and requirements. The securing process may involve aligning the expanded adjustable vent cover assembly 10 with the vent opening to ensure proper coverage and positioning before applying the selected attachment method. The installer may verify that the adjustable vent cover assembly 10 completely covers the opening with appropriate overlap or clearance around the perimeter, and that the mesh panels are properly positioned to provide effective airflow and debris blocking capability.

The securing process may involve using mounting features selected from the group consisting of a front flange, mechanical fasteners, adhesive mounting, and bracket attachment points. The selection of mounting approach may depend on factors such as the mounting surface material, accessibility constraints, permanence requirements, and aesthetic considerations. The installer may evaluate the available mounting options and select the approach that provides the most appropriate combination of security, ease of installation, and compatibility with the specific installation environment.

In some cases, securing the adjustable vent cover assembly 10 may comprise using a front flange extending outward from a perimeter of the assembled leaves and mechanical fasteners extending through apertures in the frames. The front flange mounting approach may involve positioning the adjustable vent cover assembly 10 so that the front flange rests against the mounting surface surrounding the vent opening, creating an overlapping interface that conceals the edges of the opening and provides a finished appearance. The installer may align the apertures in the frames with appropriate locations on the mounting surface, taking care to avoid interference with structural elements or utilities that may be present behind the mounting surface.

The mechanical fastener installation may involve drilling pilot holes in the mounting surface at locations corresponding to the apertures in the assembly frames, with the pilot hole size selected to provide appropriate holding power for the fastener type and mounting surface material. The installer may use wood screws, sheet metal screws, or other appropriate fasteners based on the mounting surface composition and the load requirements of the installation. The fasteners may be driven through the apertures in the frames and into the mounting surface, with the fastener heads seated flush with or slightly below the surface of the assembly to maintain a finished appearance and prevent interference with adjacent components.

The adhesive mounting approach may involve preparing the mounting surface and the adjustable vent cover assembly 10 interface areas to ensure proper adhesive bond formation. The installer may clean both surfaces to remove dust, oils, or other contaminants that could interfere with adhesive performance, and may apply primer or surface treatment materials if recommended by the adhesive manufacturer. The adhesive material may be applied to designated mounting surfaces on the assembly or to the mounting surface around the vent opening, depending on the specific adhesive system being used. The adjustable vent cover assembly 10 may be positioned against the mounting surface and pressed firmly to establish initial contact, with appropriate pressure maintained for the time period specified by the adhesive manufacturer to achieve proper bond formation.

The bracket attachment approach may involve installing separate bracket hardware to the mounting surface before positioning and securing the assembly. The installer may mark and drill mounting holes for the bracket components, taking care to ensure proper alignment and spacing that will accommodate the assembly attachment points. The brackets may be secured to the mounting surface using appropriate fasteners, with the bracket positioning verified to ensure compatibility with the assembly attachment points. The adjustable vent cover assembly 10 may then be positioned and secured to the installed brackets using the designated attachment hardware, which may include screws, clips, or other mechanical fastening systems integrated with the bracket design.

Following the completion of the securing process, the installer may perform final verification procedures to ensure proper installation and operation of the adjustable vent cover assembly 10. The verification process may include visual inspection of the mounting attachment to confirm that all fasteners are properly seated and that the assembly is securely attached to the mounting surface. The installer may also check the alignment and positioning of the assembly relative to the vent opening to ensure complete coverage and proper clearance around the perimeter. The mesh panels may be inspected to verify that they remain properly tensioned and aligned within their respective frames, and that no damage or distortion occurred during the installation process.

The installer may also verify that the dimensional adjustment of the adjustable vent cover assembly 10 remains stable after installation, with the sliding leaves 12 maintaining their expanded positions without drift or movement that could affect the coverage or fit of the assembly. The clip-and-rail guiding system may be checked to ensure that the clips remain properly engaged with their corresponding rails and that no separation or loosening has occurred during the installation process. The overall structural integrity of the installed adjustable vent cover assembly 10 may be assessed by applying gentle pressure to various portions of the adjustable vent cover assembly 10 to confirm that the mounting attachment provides adequate support and that the adjustable vent cover assembly 10 does not exhibit excessive movement or vibration.

The completed installation may provide a secure, properly fitted vent cover that accommodates the specific dimensions of the vent opening while maintaining the adjustability features for potential future reconfiguration or relocation. The installation method may be documented for future reference, including the specific dimensional settings used, the mounting approach selected, and any special considerations or modifications that were made during the installation process. This documentation may be valuable for maintenance, inspection, or replacement activities that may be performed in the future.

System Integration and Functional Operation

The adjustable vent cover assembly may operate as an integrated system where the plurality of leaves, guiding mechanisms, and mounting features function cooperatively to provide dimensional flexibility while maintaining structural integrity and ventilation performance. The system integration may involve coordinated interaction between the sliding components, mechanical constraints, and attachment interfaces to achieve reliable operation across the full range of dimensional adjustments. The functional operation may depend on the precise coordination of multiple mechanical interfaces that allow controlled movement while preventing unwanted displacement or separation of components during adjustment and service conditions.

The plurality of leaves may function as the primary structural and filtration components of the system, with each leaf contributing to both the overall coverage area and the dimensional adjustability capability. Each leaf including a rigid frame and a mesh panel secured within the frame may provide a modular building block that combines structural support, dimensional control, and airflow management in a single integrated component. The rigid frame of each leaf may serve as the primary load-bearing structure that interfaces with adjacent leaves through the guiding system while also providing mounting points for the mesh panel and connection interfaces for the overall mounting system. The mesh panel secured within each frame may provide the filtration function while allowing controlled airflow passage, with the mesh material selection and mounting method coordinated to maintain proper tension and alignment throughout the dimensional adjustment range.

The overlapping configuration of the leaves may create a layered structure where adjacent leaves interact through controlled sliding interfaces that maintain complete coverage while allowing dimensional expansion. The leaves configured to overlap and slide relative to one another may create a telescoping effect where the overall assembly dimensions change through coordinated movement of individual components rather than deformation of any single element. The sliding motion may occur along predetermined vectors established by the geometric arrangement of the leaves and the mechanical constraints imposed by the guiding system, with each leaf contributing to either width expansion, height expansion, or both depending on the specific configuration and adjustment state of the assembly.

The cross-sliding configuration may involve positioning the leaves so that different leaf pairs control expansion along perpendicular axes, creating two-dimensional adjustability through coordinated sliding motion. The four leaves arranged in a cross-sliding configuration may provide independent control of width and height dimensions, with the sliding vectors oriented to allow simultaneous or sequential adjustment of both dimensions as needed to match specific opening requirements. The cross-sliding arrangement may also provide mechanical redundancy where multiple leaves contribute to coverage in overlapping areas, ensuring that dimensional adjustment does not create gaps or uncovered areas that could compromise the filtration or debris-blocking function of the assembly.

The guiding system may serve as the mechanical interface that controls and constrains the sliding motion between adjacent leaves while maintaining proper alignment and preventing separation during operation. The guiding system configured to constrain sliding motion of the leaves may provide directional control that ensures smooth, linear movement along predetermined vectors while preventing binding, jamming, or unwanted movement in other directions. The mechanical constraints imposed by the guiding system may also provide retention forces that keep the leaves properly engaged with one another throughout the adjustment range, preventing separation that could compromise structural integrity or create safety hazards during handling or installation operations.

The clip-and-rail system may function as a specific implementation of the guiding system that provides both directional constraint and mechanical retention through complementary geometric features formed on adjacent leaves. The clips secured to a first leaf and rails formed by bent lateral flanges in a frame of an adjacent second leaf may create a mechanical interface that allows controlled sliding while preventing separation or misalignment. The channel-like relationship between each clip and corresponding rail may provide continuous guidance throughout the sliding motion, with the geometric constraints of the channel preventing movement perpendicular to the intended sliding direction while allowing smooth linear motion along the rail axis.

The engagement between clips and rails may also provide tactile feedback during adjustment operations, allowing users to sense the mechanical constraints and confirm proper sliding motion through the resistance and guidance forces transmitted through the clip-and-rail interface. The at least six clips distributed along interacting leaves may provide multiple guidance points that distribute mechanical loads and provide redundant constraint, ensuring that the sliding motion remains controlled and aligned even if individual clips experience wear or slight deformation over time. The formed steel elements welded to the first leaf may provide permanent attachment and structural continuity that maintains the integrity of the guiding system throughout repeated adjustment cycles and service conditions.

The mounting features may integrate with the leaf structure and guiding system to provide secure attachment to the installation surface while accommodating the dimensional adjustability of the assembly. The mounting features selected from the group consisting of a front flange extending outward from a perimeter of the assembled leaves, apertures for mechanical fasteners, adhesive mounting surfaces, and bracket attachment points may provide multiple attachment options that can be coordinated with different installation requirements and mounting surface conditions. The integration of mounting features with the adjustable leaf structure may involve positioning attachment points in areas that do not interfere with the sliding motion while providing adequate load distribution and structural support for the installed assembly.

The front flange extending outward from a perimeter of the assembled leaves may provide a mounting interface that moves and adjusts with the overall assembly dimensions, maintaining proper coverage and sealing around the vent opening regardless of the expansion state of the leaves. The front flange may be formed as an integral part of one or more leaf frames, creating a continuous mounting surface that expands and contracts with the overall assembly while maintaining structural continuity and load distribution capability. The apertures for mechanical fasteners may be positioned within the front flange or leaf frame structure to provide secure attachment points that remain accessible and properly aligned throughout the dimensional adjustment range.

The operational sequence during installation may involve coordinated adjustment of the leaf positions followed by activation of the mounting system to secure the assembly in the desired configuration. The method of installing an adjustable vent cover assembly may begin with the assembly in a contracted state where the leaves overlap substantially, followed by dimensional adjustment through controlled sliding motion, and concluding with activation of the selected mounting approach to secure the assembly in the expanded configuration. The installation sequence may be designed to accommodate the mechanical constraints of the guiding system while ensuring that the mounting features remain accessible and functional throughout the adjustment and securing process.

The dimensional adjustment process may involve applying controlled forces to slide the leaves relative to one another using the clip-and-rail guiding system that constrains sliding motion to linear vectors. The adjustment forces may be transmitted through the rigid frame structures of the leaves, with the guiding system providing mechanical feedback that indicates proper sliding motion and prevents over-extension or binding. The clip-and-rail guiding system may also provide retention forces that maintain the adjusted configuration during the mounting process, preventing unwanted movement or dimensional changes while the mounting features are being activated and secured.

The securing process may involve coordinating the mounting feature activation with the final positioning of the leaves to ensure that the assembly remains properly configured and aligned during attachment. Securing the assembly to cover the vent opening may involve simultaneous engagement of multiple mounting points distributed around the perimeter of the assembly, with the mounting forces distributed through the leaf frame structures and transmitted to the installation surface through the selected mounting interface. The mounting system may be designed to accommodate minor dimensional variations or installation tolerances while maintaining secure attachment and proper sealing around the vent opening perimeter.

The functional operation of the completed installation may involve passive performance of the ventilation and filtration functions while maintaining dimensional stability under normal service conditions. The mesh panel comprising fine metal mesh may provide controlled airflow passage while blocking debris, insects, and other unwanted materials, with the mesh material selection and mounting method coordinated to maintain proper filtration performance throughout the service life of the assembly. The rigid frame of each leaf formed from steel may provide structural support that maintains the dimensional configuration and mounting attachment under airflow forces, thermal cycling, and other environmental conditions encountered in typical exterior vent applications for crawl-spaces and attics.

The system integration may also accommodate maintenance and service operations that may be required during the service life of the assembly. The adjustable configuration may allow the assembly to be reconfigured or relocated to different vent openings without requiring replacement or modification, providing operational flexibility that may extend the useful life of the assembly and reduce long-term maintenance costs. The modular leaf structure may also allow individual components to be serviced or replaced independently, with the guiding system and mounting features designed to accommodate disassembly and reassembly operations as needed for cleaning, repair, or component replacement activities.

Advantages

The adjustable vent cover assembly may provide several advantages over conventional fixed-dimension vent covers commonly used for exterior openings in crawl-spaces and attics. The dimensional flexibility offered by the sliding leaf configuration may eliminate the need for maintaining extensive inventories of different-sized vent covers, as a single adjustable unit may accommodate multiple opening sizes within its adjustment range. This versatility may reduce procurement costs for contractors and building owners while simplifying the selection process during installation or replacement operations. The adjustable design may significantly reduce the need for custom-sized vents, which are often expensive and time-consuming to manufacture for non-standard openings. The ability to adjust both width and height dimensions independently may also provide compatibility with non-standard opening sizes that might otherwise require custom manufacturing or modification of existing openings.

The structural design of the assembly may offer enhanced durability and reliability compared to conventional adjustable vent covers that often suffer from mechanical weakness or poor alignment when extended. The clip-and-rail guiding system may provide precise mechanical constraint that maintains proper alignment between adjacent leaves throughout the adjustment range, preventing wobbling, rattling, or gap formation that can compromise both aesthetic appearance and functional performance. The steel construction of the rigid frames and the welded attachment of the clips may provide long-term structural integrity under repeated adjustment cycles and environmental exposure conditions encountered in typical exterior vent installations.

The installation versatility provided by multiple mounting options may accommodate various architectural environments and construction scenarios without requiring specialized tools or modification of standard installation practices. The front flange mounting approach may provide a finished appearance that conceals opening edges while distributing mounting loads across a larger surface area. The mechanical fastener apertures may allow secure attachment using standard hardware, while the adhesive mounting and bracket attachment options May provide alternatives for situations where conventional fastening methods may not be suitable. This flexibility in mounting approaches may reduce installation time and complexity while ensuring secure attachment across different building materials and surface conditions.

The maintenance and service advantages of the adjustable design may contribute to reduced long-term operating costs and extended service life compared to fixed-dimension alternatives. The ability to reconfigure or relocate the assembly to different vent openings may eliminate the need for replacement when building modifications or renovations alter opening dimensions. The modular leaf structure may allow individual components to be cleaned, repaired, or replaced independently without requiring replacement of the entire assembly, potentially reducing maintenance costs and minimizing system downtime during service operations.

A number of implementations have been described. Nevertheless, it will be understood that various modifications may be made without departing from the spirit and scope of the disclosure. Accordingly, other implementations are within the scope of the following claims.

We claim:

1. An adjustable vent cover assembly, comprising:

a plurality of leaves, each leaf including a rigid frame and a mesh panel secured within the frame, wherein the plurality of leaves are configured to overlap and slide relative to one another to allow the assembly to expand and contract in both width and height dimensions, and wherein the assembly is configured for continuous adjustment to any position within an adjustment range, wherein the plurality of leaves comprises at least two leaves arranged in a cross-sliding configuration, wherein the adjustable vent cover assembly further comprises a guiding system that constrains sliding motion of the plurality of leaves to linear vectors and maintains alignment between adjacent leaves, wherein the guiding system comprises clips secured to a first leaf and rails on an adjacent second leaf, wherein each clip engages a corresponding rail in a channel-like relationship, wherein the guiding system employs at least six clips distributed along the plurality of leaves, wherein the clips are secured to the first leaf, wherein the mesh panel comprises ember-resistant mesh having apertures of ⅛ inch or smaller, wherein the assembly is configured for tool-free adjustment, wherein the assembly is configured to expand from a contracted state to an expanded state with expansion ranges allowing coverage from approximately 10×5 inches to approximately 17×8 inches.

2. The adjustable vent cover assembly of claim 1, wherein the rigid frame of each leaf is formed from a metallic material.

3. The adjustable vent cover assembly of claim 1, further comprising mounting features selected from the group consisting of a front flange extending outward from a perimeter of the plurality of leaves, apertures for mechanical fasteners, adhesive mounting surfaces, and bracket attachment points.

4. A method of installing an adjustable vent cover assembly, comprising:

providing an adjustable vent cover assembly having a plurality of sliding leaves configured to expand and contract in both width and height;

adjusting the dimensions of the assembly to fit a vent opening; and securing the assembly to cover the vent opening, wherein the plurality of sliding leaves comprises at least two leaves arranged in a cross-sliding configuration, each leaf including a rigid frame and a mesh panel secured within the frame, wherein adjusting the dimensions comprises sliding the plurality of sliding leaves relative to one another using a guiding system that constrains sliding motion to linear vectors, wherein the guiding system comprises clips secured to a first leaf and rails on an adjacent second leaf, and wherein each clip engages a corresponding rail in a channel-like relationship;

wherein the plurality of sliding leaves comprises at least two leaves with rigid frames formed from metallic material and mesh panels comprising mesh material selected from the group consisting of wire mesh, perforated sheet material, expanded metal, and fire-resistant fabric, wherein the mesh panel comprises ember-resistant mesh having apertures of ⅛ inch or smaller, wherein the guiding system employs at least six clips distributed along the plurality of sliding leaves with the clips being secured to the first leaf, wherein the guiding system alternatively comprises one of tongue-and-groove joints or dovetail joints between adjacent leaves, wherein adjusting the dimensions comprises expanding the assembly from a contracted state where the leaves overlap substantially to an expanded state with expansion ranges allowing coverage from approximately 10×5 inches to approximately 17×8 inches, wherein the assembly is configured for tool-free adjustment, and wherein securing the assembly comprises using a front flange extending outward from a perimeter of the adjustable vent cover assembly and mechanical fasteners extending through apertures in the frames.

5. The method of claim 4, wherein securing the assembly comprises using mounting features selected from the group consisting of a front flange, mechanical fasteners, adhesive mounting, and bracket attachment points.

* * * * *